US010211566B2

(12) United States Patent
Nagayama et al.

(10) Patent No.: US 10,211,566 B2
(45) Date of Patent: Feb. 19, 2019

(54) CONNECTOR UNIT

(71) Applicant: Yazaki Corporation, Minato-ku, Tokyo (JP)

(72) Inventors: Masataka Nagayama, Makinohara (JP); Kenji Takahashi, Makinohara (JP); Kazuhide Takahashi, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/138,457

(22) Filed: Apr. 26, 2016

(65) Prior Publication Data

US 2016/0322741 A1 Nov. 3, 2016

Related U.S. Application Data

(63) Continuation of application No. PCT/JP2014/079381, filed on Oct. 29, 2014.

(30) Foreign Application Priority Data

Oct. 29, 2013 (JP) ..... 2013-223892
Nov. 21, 2013 (JP) ..... 2013-241204
(Continued)

(51) Int. Cl.
*H01R 13/58* (2006.01)
*H01R 13/506* (2006.01)
*H01R 25/00* (2006.01)

(52) U.S. Cl.
CPC ..... *H01R 13/5825* (2013.01); *H01R 13/506* (2013.01); *H01R 13/5841* (2013.01); *H01R 25/003* (2013.01); *H01R 2201/26* (2013.01)

(58) Field of Classification Search
CPC .... H01R 13/506; H01R 13/595; H01R 13/56; H01R 13/516; H01R 13/5808; H01R 13/5812; H01R 13/5804; H01R 2103/00
(Continued)

(56) References Cited

U.S. PATENT DOCUMENTS 3,920,306 A 11/1975 Barnett, Jr. et al.
4,900,277 A 2/1990 Inaba et al.
(Continued)

FOREIGN PATENT DOCUMENTS

CN 1197314 A 10/1998
CN 102195193 A 9/2011
(Continued)

OTHER PUBLICATIONS

Jan. 20, 2015—International Search Report—Intl App PCT/JP2014/079381.
(Continued)

*Primary Examiner* — Hien Vu
(74) *Attorney, Agent, or Firm* — Banner & Witcoff, Ltd.

(57) ABSTRACT

In a connector unit including a connector and a connector cover that fits on the connector, the connector includes a guide means that guides electric wires in one direction, while the connector cover includes a pressing means that presses on and deforms the guide means so as to restrict the movement of the electric wires that are guided by the guide means, whereby the electric wires that are pulled out of the connector are oriented in the one direction in which the electric wires are guided by the guide means.

7 Claims, 31 Drawing Sheets

(30) Foreign Application Priority Data

Nov. 21, 2013 (JP) ..... 2013-241206
Nov. 21, 2013 (JP) ..... 2013-241209

(58) Field of Classification Search
USPC ..... 439/466, 468, 470, 472, 473
See application file for complete search history.

(56) References Cited

U.S. PATENT DOCUMENTS

| | | | | |
|---|---|---|---|---|
| 5,259,785 | A * | 11/1993 | Inaba | H01R 13/506 439/364 |
| 5,306,195 | A | 4/1994 | Hayashi | |
| 5,444,182 | A | 8/1995 | Hoshino | |
| 5,600,747 | A | 2/1997 | Yamakawa et al. | |
| 5,672,077 | A * | 9/1997 | Wang | H01R 33/09 439/619 |
| 5,848,916 | A | 12/1998 | Huang | |
| 5,908,327 | A | 6/1999 | Tsuji et al. | |
| 5,921,806 | A | 7/1999 | Shuey | |
| 6,022,241 | A * | 2/2000 | Lin | H01R 4/2412 362/257 |
| 6,231,375 | B1 | 5/2001 | Kashiyama | |
| 6,422,884 | B1 | 7/2002 | Babasick et al. | |
| 7,537,478 | B2 * | 5/2009 | Foltz | H02G 3/0487 439/466 |
| 8,251,761 | B2 | 8/2012 | Shamoto et al. | |
| 9,130,283 | B1 * | 9/2015 | Lin | H01R 4/2433 |
| 9,570,841 | B2 | 2/2017 | Kitamura et al. | |
| 9,698,523 | B2 | 7/2017 | Kitamura et al. | |
| 2009/0020309 | A1 | 1/2009 | Foltz et al. | |
| 2009/0029579 | A1 | 1/2009 | Hiramatsu | |
| 2011/0230106 | A1 | 9/2011 | Shamoto et al. | |
| 2016/0197435 | A1 | 7/2016 | Kitamura et al. | |
| 2016/0240963 | A1 | 8/2016 | Kitamura et al. | |
| 2016/0322741 | A1 | 11/2016 | Nagayama et al. | |
| 2017/0279218 | A1 | 9/2017 | Nagayama et al. | |

FOREIGN PATENT DOCUMENTS

| | | | |
|---|---|---|---|
| CN | 105453347 | A | 3/2016 |
| CN | 105637718 | A | 6/2016 |
| DE | 3939967 | A1 | 6/1991 |
| EP | 0913890 | A2 | 5/1999 |
| JP | S52-115894 | U | 9/1977 |
| JP | H01-105482 | A | 4/1989 |
| JP | H03-086570 | U | 9/1991 |
| JP | H05-053155 | U | 7/1993 |
| JP | H05-067132 | U | 9/1993 |
| JP | H08-106029 | A | 4/1996 |
| JP | H08-322133 | A | 12/1996 |
| JP | H09-092379 | A | 4/1997 |
| JP | 3064488 | U | 1/2000 |
| JP | 2009-093860 | A | 4/2009 |
| JP | 2010-267488 | A | 11/2010 |
| JP | 2011-086544 | A | 4/2011 |
| JP | 2013-105524 | A | 5/2013 |
| JP | 2013-143265 | A | 7/2013 |
| JP | 2015-035385 | A | 2/2015 |
| JP | 2015-088256 | A | 5/2015 |

OTHER PUBLICATIONS

Jan. 20, 2015—Written Opinion of ISA—Intl App PCT/JP2014/079381.
May 12, 2017—(CN) The First Office Action—App 201480059990.4.
Jul. 25, 2017—(JP) Notification of Reasons for Refusal—App 2013-223892.
Jul. 25, 2017—(JP) Notification of Reasons for Refusal—App 2013-241206.
Jan. 16, 2018—Decision of Refusal—App 2013-223892.
Jan. 16, 2018—Notification of Reasons for Refusal—App 2017-073431.
Dec. 4, 2017—(CN) Second Office Action—App 201480059990.4.
Aug. 7, 2018—(JP) Notification of Reasons for Refusal—App 2017-073431.
Apr. 30, 2018—U.S. Non-Final Office Action—U.S. Appl. No. 15/581,345.
Nov 9, 2018—(US) Final Office Action—U.S. Appl. No. 15/581,345.
Oct. 22, 2018—(CN) the First Office Action—App 201710294744.2.

* cited by examiner 414B
414'
414A
W1
W2
(B)

413
A
A
W1
W2
W3 · · · Wn
411D
414A
414
14B
412
(R)

411
414B
Wn
W3 · · · Wn
414
414A
411D
W1
W2
(A)

411
Wn
W3
W2
W1
W2

W1
W2
414
411D
411
(H)
412
(S)

W1
W2
W3
Wn
412
(T)

411D
W2
411
W3
Wn · · · W3
414B
413
414A
414
(L)
412

(1) (2)

FIG. 31A
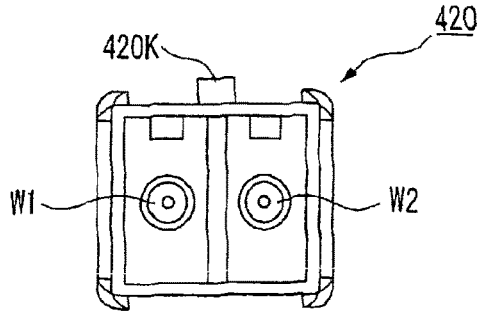
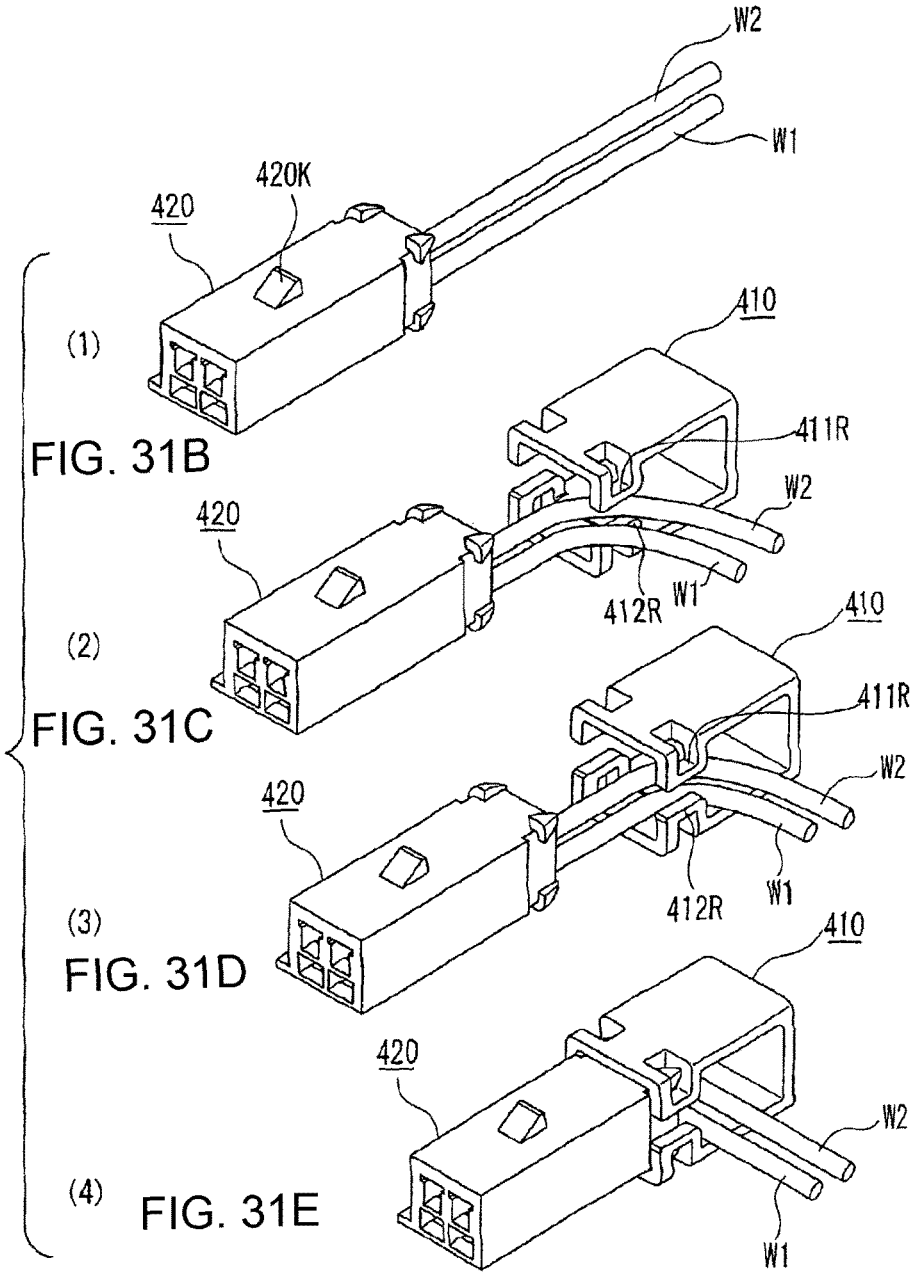
FIG. 31B
FIG. 31C
FIG. 31D
FIG. 31E

CONNECTOR UNIT

CROSS REFERENCE TO RELATED APPLICATIONS

This application is a continuation of PCT application No. PCT/JP2014/079381, which was filed on Oct. 29, 2014 based on Japanese patent applications No. 2013-223892 filed on Oct. 29, 2013, No. 2013-241204 filed on Nov. 21, 2013, No. 2013-241206 filed on Nov. 21, 2013, No. 2013-241209 filed on Nov. 21, 2013, whose contents are incorporated herein by reference. Also, all the references cited herein are incorporated as a whole.

BACKGROUND OF THE INVENTION

1. Technical Field

The present invention relates to a connector unit that includes a connector and a connector cover that fits on the connector and protects an electric wire that is pulled out of or exit from the connector.

2. Background Art

Connectors have conventionally been used to electrically connect electronic equipment and electric wires together. Depending on fields to which connectors are applied, a connector cover is added to a connector not only to protect electric wires that are pulled out of or exit from the connector but also to prevent the electric wires from being entangled or the electric wires from being caught by a case that houses the electronic equipment, whereby the electric wires are not only protected but also oriented in one direction by the connector cover.

As an example of such a connector, a connector that is used in a vehicle gearbox will be described by the use of FIG. 7.

In FIG. 7, reference numeral 70 denotes a gearbox, and reference numeral 60 denotes a case of the gearbox 70. A plurality of solenoids 50 are placed in an interior of the case 60 to shift gears not shown, and male, equipment-side connectors 40 are provided individually in the solenoids 50.

On the other hand, electric wires 23 that carry drive signals from the outside are connected to female connectors 20 that fit in the equipment-side connectors 40. Then, by joining the male and female connectors together, drive signals are transmitted individually to the solenoids 50 from the outside.

Here, paying attention to the female connectors 20 to which the electric wires 23 are connected, a connector cover 10 is fitted on each connector 20 (hereinafter, the connector cover 10 and the connector 20 will be referred to together as a "connector unit 30".) not only to protect the electric wires 23 that are pulled out of the connector 20 but also to orient the electric wires 23 in one direction (a lay-out direction), whereby the electric wires 23 that are pulled out of each connector 20 are prevented from getting entangled or the electric wires 23 are prevented from being caught between the case 60 and a cover, not shown, in sealing up the gearbox 70 by attaching the cover to the case 60 by using screw holes 61.

As the connector cover 10, for example, what is described in JP-A-2013-105524 is used.

SUMMARY

In general, however, the electric wires that are pulled out of the connector extend straight from the connector (substantially perpendicularly to a plane of the connector of which the electric wires are pulled out), and therefore, the conventional connector unit has a problem that even though the electric wires that are pulled out thereof are attempted to be oriented in one direction, it is not easy to align the electric wires neatly in the one direction. Additionally, the conventional connector unit has a problem that when a force is applied to the electric wires for some reason such as pulling the electric wires in an attempt to orient them in one direction, the force is transferred directly to the connecting portion between the connector and the electric wires, resulting in fears that a deformation or failure of a terminal in the connector or a connection failure is called for.

Then, the invention has been made in view of the problems inherent in the conventional connector unit. A technical problem that the invention is to solve is how to orient electric wires that are pulled out of a connector in one direction simply and easily.

In addition, another technical problem that the invention is to solve is how to provide a highly reliable connector unit in which a deformation or failure of a terminal within a connector or a connection failure is made difficult to occur even though a force is applied to electric wires.

Further, the other technical problem that the invention is to solve is how to realize a highly versatile connector unit at low cost.

Solution to Problem

The problems that the invention is to solve are solved by the following configurations.

(1) A connector unit including a connector for execution of an electric connection and a connector cover that fits on the connector and protects an electric wire that is pulled out of the connector, wherein the connector comprises a guide means that guides an electric wire that is pulled out of the connector in one direction, and wherein the connector cover comprises a pressing means that restricts a movement of the electric wire that is guided by the guide means by pressing to deform the guide means.

(2) The connector unit according to (1), wherein the guide means projects substantially into an L-shape from a plane of the connector of which an electric wire is pulled out.

(3) The connector unit according to (2), wherein the connector comprises a plurality of guide means like the guide means, and wherein the individual guide means is intended to guide electric wires that are pulled out of the connector in different directions from each other.

(4) The connector unit according to (1), wherein the connector cover comprises further a space portion that allows an electric wire to pass therethrough in one direction.

(5) A connector unit having a connector including a connector housing that accommodates a terminal that is attached to an electric wire and an connector cover that is assembled to an electric wire pull-out opening in the connector housing so as not only to guide the electric wire that is pulled out of the connector housing in a lay-out direction but also to protect the electric wire, wherein the connector cover has a bottomed tubular shape, and two electric wire passage openings are formed in side walls of the connector cover, the two electric wire passage openings constituting an entrance or an exit for the electric wire that is laid out from a different connector cover like the connector cover to be allowed to pass therethrough to be guided in a lay-out direction and also an exit from which the electric wire from the electric wire pull-out opening is pulled out in a lay-out direction.

(6) The connector unit according to (5), wherein the connector cover is axially symmetrical, and wherein the connector housing has an axially symmetrical shape in which an axis of an electric wire pull-out-side end portion of the connector housing coincides with an axis of an opening-side end portion of the connector cover, enabling the electric wire pull-out-side end portion to fit into the opening-side end portion.

(7) The connector unit according to (6), wherein the connector unit has further an axial rotation locking portion that locks the connector cover and the connector housing at a plurality of locations where the connector cover is rotated about the axis thereof relative to the connector housing so as to be oriented accordingly.

(8) The connector unit according to (5), wherein in the connector cover, an external shape of a section that is at right angles to the axis is square, and wherein in the connector housing, an external shape of a section that is at right angles to the axis so that the electric wire pull-out-side end portion of the connector housing can fit in the opening-side end portion of the connector cover is square.

(9) The connector unit according to (5), wherein in the connector cover, an external shape of a section that is at right angles to the axis of the opening-side end portion of the connector cover is circular, and wherein in the connector housing, an external shape of a section that is at right angles to the axis so that the electric wire pull-out-side end portion of the connector housing can fit in the opening-side end portion of the connector cover is circular.

(10) The connector unit according to (1), the connector cover further comprises a turn restricting projection that is brought into abutment with the electric wire passing through the electric wire passage opening, wherein in the event that the connector cover turns relative to the electric wires passing through the electric wire passage opening, the turn restricting projection is brought into abutment with the electric wires to thereby restrict the turning of the connector cover.

(11) A connector unit comprising:

a connector that accommodates terminals that are electrically connected to distal ends of branch wires that branch off trunk wires; and a connector cover that is formed into the shape of a bottomed tube having a bottom wall and side walls and that is assembled to an end of the connector where a pull-out plane of which the branch wires are pulled out is present, the connector cover guiding the branch wires and the trunk wires in a direction in which the branch wires and the trunk wires are laid out, wherein the connector cover has electric wire passage openings that are formed in the side walls that face each other and a turn restricting projection that is formed on the bottom wall, and the trunk wires are passed through the electric wire passage openings and the branch wires are pulled out of the electric wire passage opening, and wherein in the event that the connector cover turns relative to the trunk wires, the turn restricting projection is brought into abutment with the trunk wires to thereby restrict the turning of the connector cover.

(12) A connector unit comprising a connector and a connector cover that is fitted to an electric wire pull-out end of the connector, wherein the connector cover is a hollow rectangular parallelepiped member (including a hollow cubical member) with both lateral side surfaces excluded, wherein a first fitting portion that comprises as part thereof a downwardly extending portion that extends downwards from a distal end of a fitting end of a ceiling portion of the hollow rectangular parallelepiped member that is fitted to the connector and an upwardly extending portion that extends from a distal end of a fitting end of a bottom portion of the hollow rectangular parallelepiped member that is fitted to the connector is provided on each of the ceiling portion and the bottom portion, and second fitting portions are provided at a fitting end of the connector that fits to the connector cover so as to fit to the first fitting portions individually, and wherein an electric wire distributing separator rib is provided so as to extend downwards from the ceiling portion or to extend upwards from the bottom portion of the hollow rectangular parallelepiped member.

(13) The connector unit according to (12), wherein an electric wire from the connector is passed through an electric wire direction restricting portion that is formed between the downwardly extending portion or the upwardly extending portion and the electric wire distributing separator rib, and electric wires from other connectors than the connector are passed through an electric wire collecting portion that is formed between the electric wire distributing separator rib and a wall portion of the connector cover.

(14) The connector unit according to (13), wherein one of electric wires from the connector is passed through the electric wire direction restricting portion, while the remaining electric wire of the electric wires from the connector is distributed around the electric wire distributing separator rib to be passed through the electric wire collecting portion.

(15) The connector unit according to (12), wherein a hinge is formed on the ceiling portion of the hollow rectangular parallelepiped member or on the bottom portion of the hollow rectangular parallelepiped member in a direction that is at right angles to a fitting direction, and as a result of the fitting end of the ceiling portion or the bottom portion being rotated about the hinge, a space is formed between a distal end of the electric wire distributing separator rib and the hinge.

According to the connector unit that is configured as described under (1) above, the connector cover has the bottomed tubular shape, and the two electric wire passage openings are formed in the side walls of the connector cover, the two electric wire passage openings constituting the entrance or the exit for the electric wire that is laid out from the different connector cover like the connector cover to be allowed to pass therethrough to be guided in the lay-out direction and also the exit from which the electric wire from the electric wire pull-out opening is pulled out in the lay-out direction. When the connector cover is assembled to a plurality of connecters like the connector that are provided along the lay-out direction of the electric wire, the connector cover can be assembled to the connector without limiting the functions of the electric wire passage openings to an entrance or an exit for the electric wire. Therefore, the connector cover can be assembled to the plurality of connectors that are provided along the lay-out direction of the electric wire.

According to the connector unit that is configured as described under (2) above, the connector cover is axially symmetrical, and the electric wire pull-out-side end portion that is the end portion at the side facing the electric wire pull-out opening has the axially symmetrical shape in which the axis of the electric wire pull-out-side end portion coincides with the axis of the opening-side end portion, enabling the electric wire pull-out-side end portion to fit into the opening-side end portion. Therefore, the direction in which the connector cover is assembled to the connector housing is not limited by the respective orientations of the two electric wire passage openings. Namely, the connector cover may be assembled to the connector housing with either of the two electric wire passage openings oriented to an connector cover that lies adjacent thereto, thereby making it possible to assemble the connector cover to the connector easily.

According to the connector unit that is configured as described under (3) above, the axial rotation locking portion locks the connector cover and the connector housing at the plurality of locations where the connector cover is rotated about the axis thereof relative to the connector housing so as to be oriented accordingly. Therefore, it is possible to deal with various lay-out directions of the electric wire.

According to the connector unit that is configured as described under (4) above, the external shape of the section of the connector cover that is at right angles to the axis thereof is square, and the external shape of the section of the connector housing that is at right angles to the axis thereof so that the electric wire pull-out-side end portion can fit in the opening-side end portion is square. Therefore, it is possible to lock the connector cover and the connector housing stably every time the connector cover is rotated through 90 degrees about the axis thereof relative to the connector housing.

According to the connector unit that is configured as described under (5) above, the external shape of the section that is at right angles to the axis of the opening-side end portion of the connector cover is circular, and the external shape of the section that is at right angles to the axis so that the electric wire pull-out-side end portion can fit in the opening-side end portion is circular. Therefore, the connector cover can rotate freely about the axis thereof relative to the connector housing through any rotational angle.

According to the connector unit that is configured as described under (6) above, not only can the electric wire that is pulled out of the connector be protected, but also the electric wire can be oriented in one direction easily and in an ensured fashion. Consequently, by using the connector unit that is configured as described under (6) above, the working properties in connecting the connector to electronic equipment can be improved, and the electric wire can be prevented easily and in an ensured fashion from getting entangled or from being caught by the case.

Additionally, according to the connector that is configured as described under (6) above, the force exerted on the electric wire is mitigated by a guide means, and therefore, it is possible to realize the connector unit that has higher reliability and in which a deformation or failure of a terminal in the connector, a connection failure or the like is made difficult to occur.

According to the connector unit that is configured as described under (7) above, the guide means that guides the electric wire is constructed so as to project substantially into an L-shape from the plane of the connector of which the electric wire is pulled out, and therefore, the electric wire can be guided in one direction with the simple construction in an ensured fashion. In addition, the guide means can be formed integrally with the connector easily, and hence, it is possible to fabricate the connector unit including the guide means at low cost.

According to the connector unit that is configured as described under (8) above, the plurality of guide means like the guide means described above are provided, and the individual guide means is constructed so as to guide the electric wires that are pulled out of the connector in the different directions from each other. Therefore, it is possible to realize the highly versatile connector unit that can orient the electric wires in the various directions according to applications.

According to the connector unit that is configured as described under (9) above, the connector cover includes the space portion that allows an electric wire to pass therethrough in one direction. Therefore, for example, when electric wires that are pulled out of a plurality of connectors are guided together to the outside, electric wires that are pulled out of other connectors are allowed to pass through a space portion defined in a particular connector cover in one direction, whereby the electric wire from the particular connector and the electric wires from the other connectors are put together so as to be aligned and oriented neatly in one direction easily and an ensured fashion.

According to the connector unit described under (10) above, even when the connector cover (that is, the whole of the connector unit) turns relative to an electric wire, a turn restricting projection is brought into abutment with the electric wire to restrict the turn of the connector unit. This can prevent the turn of the whole of the connector unit relative to the electric wire, thereby making it possible to improve the working properties in attaching the connector to a mating connector.

According to the connector unit described under (11) above, even when the connector cover (that is, the whole of the connector unit) turns relative to a trunk wire, a turn restricting projection is brought into abutment with the trunk wire to restrict the turn of the connector unit. This can prevent the turn of the whole of the connector unit relative to the trunk wire, thereby making it possible to improve the working properties in attaching the connector to a mating connector.

According to the connector unit described under (12) above, using the connector cover of the invention can allow all connector units to be arranged in such a way that they are aligned in the same direction. Therefore, in fitting the connectors in or on mating connectors, the time to correct the orientations of the connector units becomes unnecessary, thereby making it possible to reduce largely the fitting time of many connectors.

In addition, electric wires that exit from those connectors can be identified individually with ease.

Further, even though the connector cover turns relative to a vertical axis that passes through a ceiling portion and a bottom portion thereof, the connector cover can be restored to its original condition.

Additionally, forming the hinge on the connector cover according to the invention creates the space between the distal end of the electric wire distributing separator rib and the hinge, and this facilitates the accommodation of a bundle of electric wires in the connector cover, thereby making it possible to reduce the time necessary to fit the connectors together.

Thus, the invention has been described briefly. The details of the invention will be clarified further by perusing a mode for carrying out the invention (hereinafter, referred to as an "embodiment") that will be described below by reference to accompanying drawings.

BRIEF DESCRIPTION OF THE DRAWINGS

FIGS. 10A and 10B show states where an connector cover is assembled to the connector with its electric wire passage openings oriented in different directions.

FIGS. 23A and 23B show perspective views depicting working effects of the connector unit according to the third embodiment, in which FIG. 23A is a perspective view showing an example of a layout form of electric wires when connector units of the earlier invention are used, and FIG. 23B is a perspective view showing an example of a layout form of electric wires when the connector units according to the third invention are used.

FIGS. 28A-28C illustrate perspective views of a connector cover improved from the connector cover shown in FIG. 24 as seen upwardly from therebelow, in which FIG. 28A is a view showing a state in which a hinge is closed, FIG. 28B is a view showing a state in which the hinge is opened, and FIG. 28C is a view showing a state in which electric wires are passed through the connector cover with the hinge opened.

FIG. 31A is a front view of a connector 420 as seen from a side facing a connector cover 410 according to a relevant invention.

FIGS. 31B-31E illustrate perspective views of the connector 420 and the connector cover 410 that illustrate a procedure of accommodating electric wires exiting from the connector 420 into the connector cover 410 according to a relevant invention.

DETAILED DESCRIPTION OF EMBODIMENTS

Hereinafter, embodiments of the invention will be described by reference to the drawings.

First Embodiment

Figure 1:
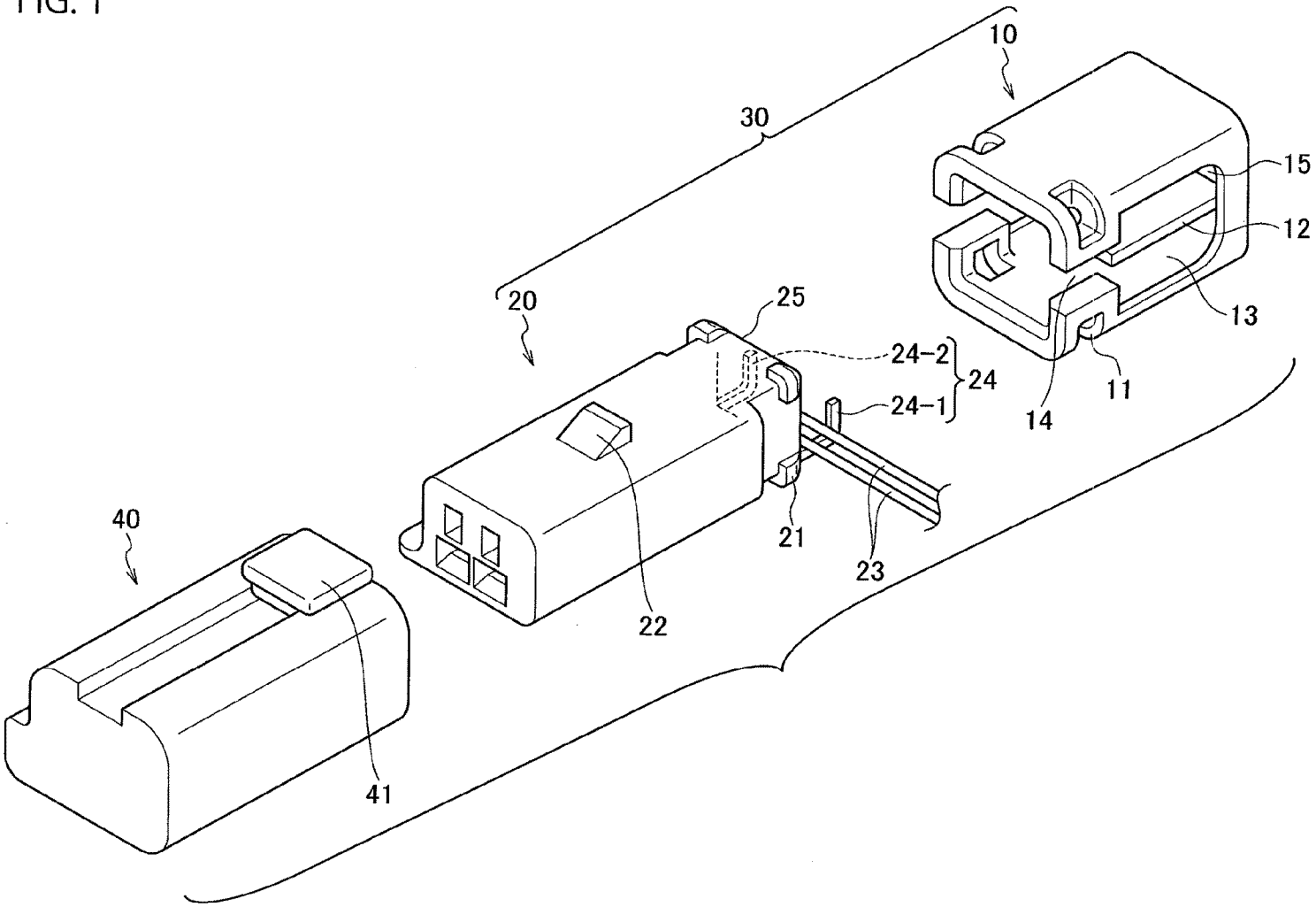
FIG. 1 is an exploded perspective view of a connector unit according to a first embodiment of the invention.

FIG. 1 is an exploded perspective view of a connector unit according to a first embodiment of the invention.

In FIG. 1, a connector cover 10 is fitted on a side of a female connector 20 where a plane (hereinafter, referred to as a "back surface") 25 exists of which electric wires 23 are pulled out by making use of back projections 21 and locking holes 11. A connector unit 30 of this embodiment is made up of this connector 20 and the connector cover 10.

In this embodiment, a male equipment-side connector 40 is placed in electronic equipment, not shown, and electrodes within the equipment-side connector 40 are connected to electric wires from the electronic equipment.

The connector 20 and the equipment-side connector 40 are joined together by bringing an upper projection 22 that is provided on the connector 20 into engagement with a locking member 41 that is provided on the equipment-side connector 40, and terminals that are provided in the individual connectors are electrically connected together.

The electric wires 23 are pulled out of the back surface 25 of the connector 20, and in this embodiment, two electric wires are pulled out thereof. Reference numeral 24 denotes a guide means 24 adapted to guide the electric wires 23 that are pulled out of the connector 20 in one direction. In this embodiment, in a state shown in FIG. 2A where the connector cover 10 has not yet been fitted thereon, the guide means 24 (24-1, 24-2) projects upwards substantially into an L-shape from left and right lower portions on the back surface 25 of the connector 20. The guide means 24 is formed of a resin and integrally with the connector and is flexible. Additionally, in this embodiment, as seen from the back surface 25, the guide means 24-1 guides the electric wires 23 to the left, and the guide means 24-2 guides the electric wires 23 to the right.

Figure 2A:
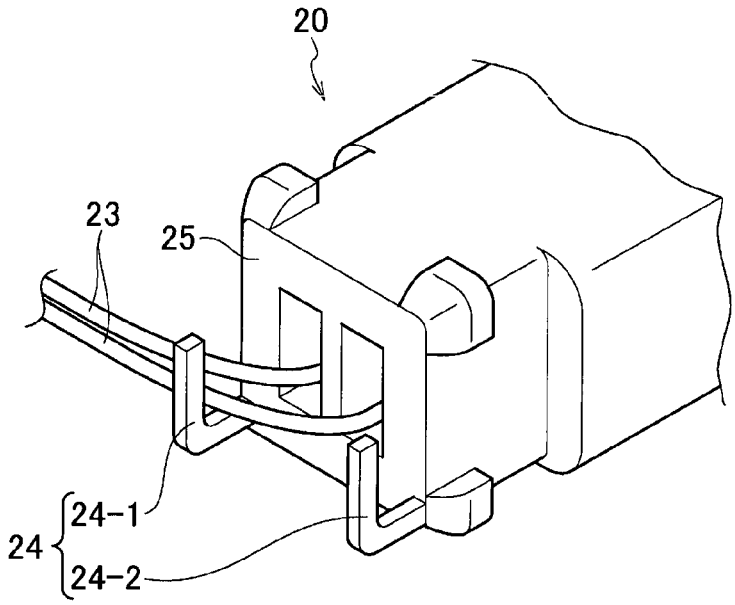
FIGS. 2A and 2B are views showing a connector cover and a connector of the connector unit according to the first embodiment of the invention that are not yet fitted together.

In FIG. 2A, the two electric wires 23 that are pulled out of the connector 20 are both guided to the left by the guide means 24-1, and the guide means 24-2 is not used. However, depending on situations, a configuration may be adopted in which the two electric wires are both guided to the right by making use of the guide means 24-2 only. Alternatively, a configuration may be adopted in which one of the electric wires is guided to the left by the guide means 24-1 and the other electric wire is guided to the right by the guide means 24-2.

A flat plate-like pressing means 12 is provided on the connector cover 10 so as to extend from a bottom surface 15 thereof towards the front. Space portions 13 are provided on both sides of this pressing means 12 so that electric wires other than the electric wires 23 that are pulled out of the connector 20 on which the connector cover 10 is fitted are allowed to pass therethrough in one direction.

Figure 3A:
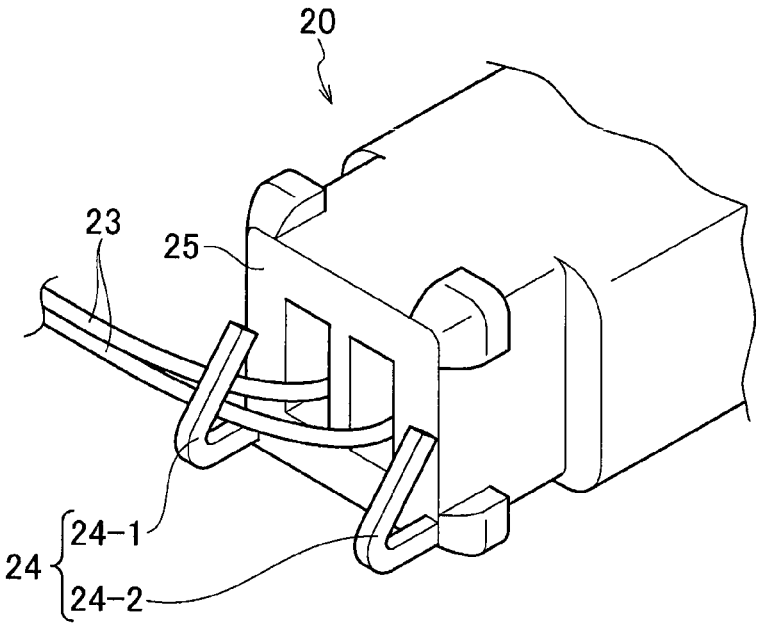
FIGS. 3A and 3B are views showing the connector cover and the connector of the connector unit according to the first embodiment of the invention that are now fitted together.
Figure 3B:
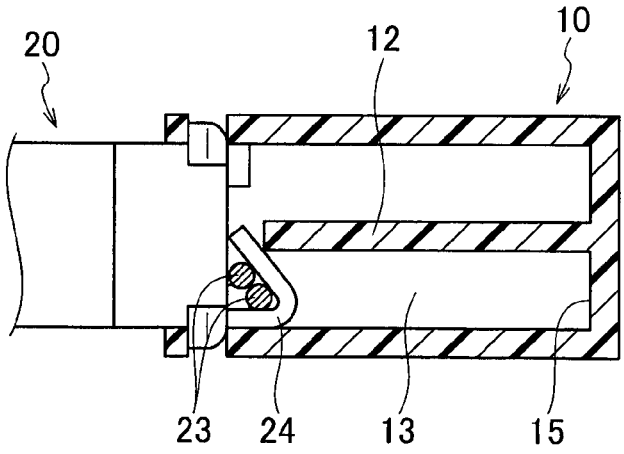

Additionally, in this embodiment, as shown in FIGS. 3A, 3B (in FIG. 3A, the connector cover 10 is not depicted so as to clearly show how the guide means 24 works.), when the connector cover 10 is fitted on the connector 20, the pressing means 12 presses on the guide means 24 to thereby deform the guide means 24, whereby the electric wires 23 that are guided by the guide means 24 are caught by the deformed guide means 24 and the back surface 25 of the connector 20, so that the electric wires 23 are restricted from moving.

Figure 6:
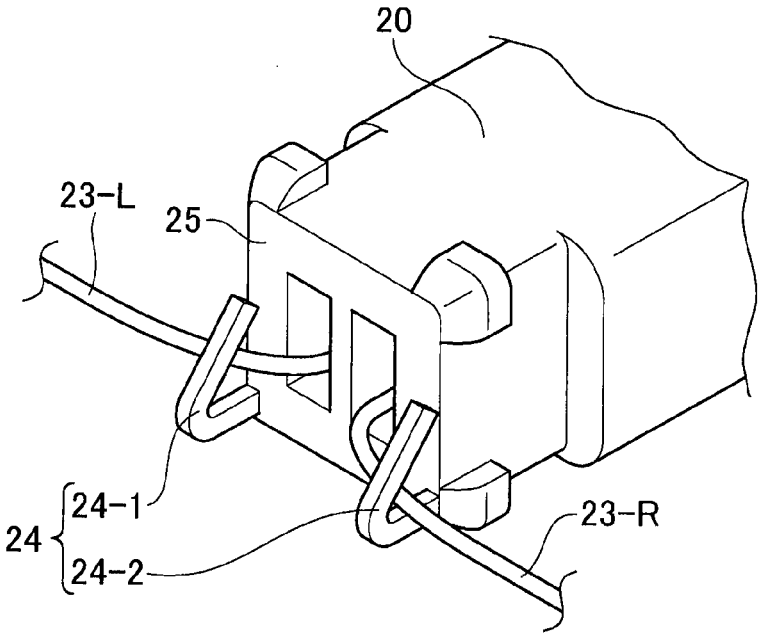
FIG. 6 is a perspective view of the connector of the connector unit according to the first embodiment of the invention showing a case where electric wires are laid out in different directions.
Figure 7:
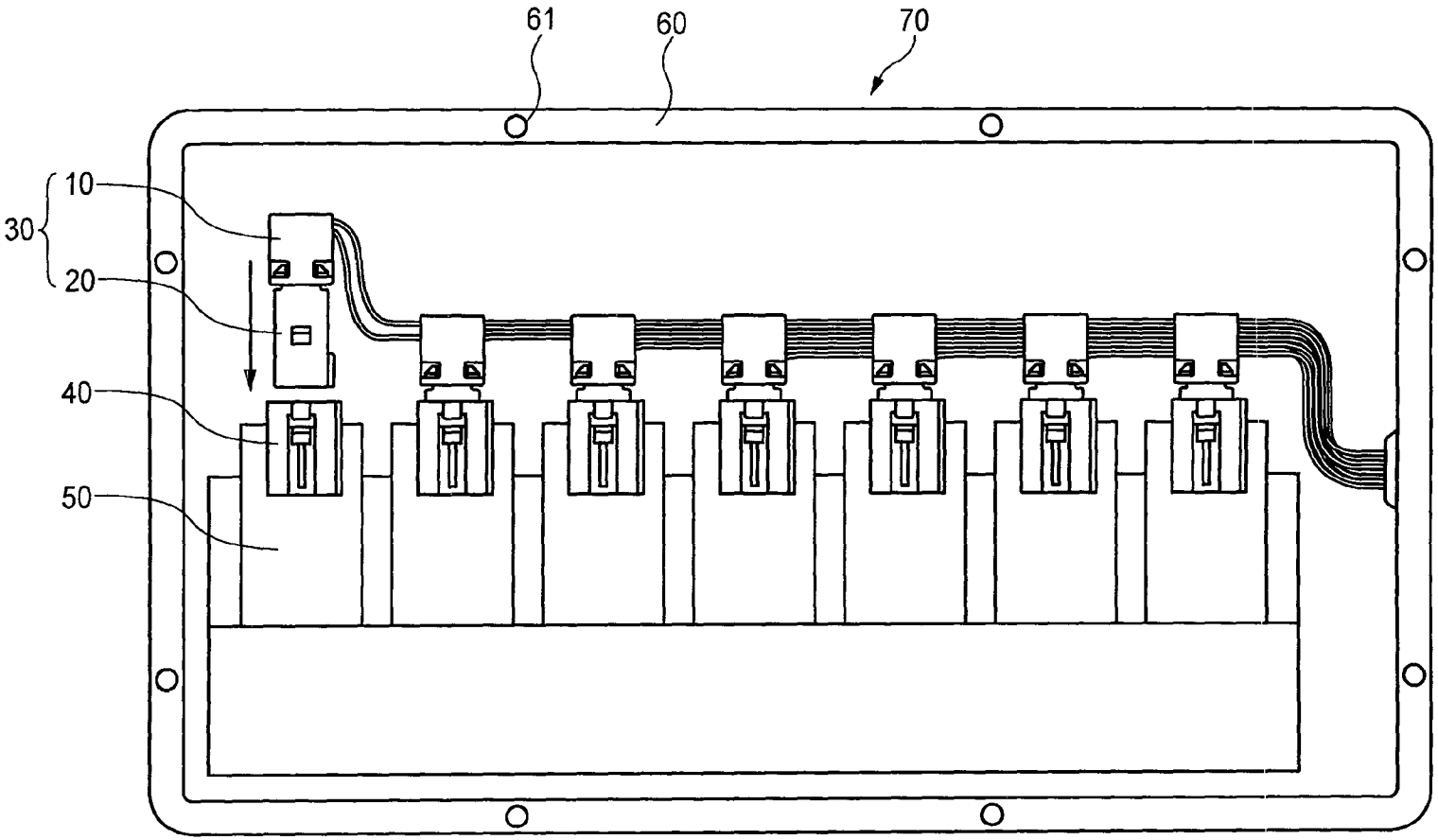
FIG. 7 is a plan view of a vehicle gearbox in which electric wires are pulled out of a plurality of connectors according to the prior art.

In FIG. 3A, of the two guide means 24, only the guide means 24-1 is used to orient the two electric wires 23 to the left as seen from the back surface 25. However, the two electric wires 23 may be guided to the right by making use of the guide means 24-2 only. Alternatively, as shown in FIG. 6, by using the two guide means 24 individually, the electric wire 23-L may be oriented to the left by the guide means 24-1, and the electric wires 23R may be oriented to the right by the guide means 24-2.

Figure 2B:
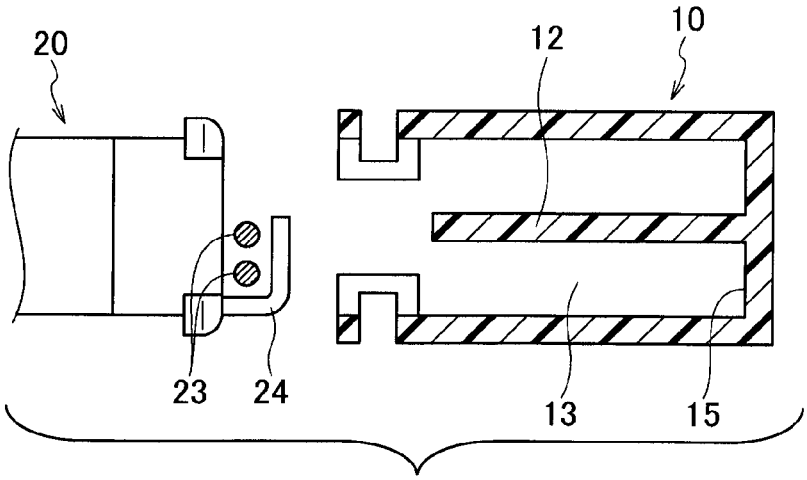

As is seen by looking at FIG. 2, the guide means 24 provided on the back surface 25 of the connector 20 only guides in one direction the two electric wires 23 pulled out before the connector cover 10 is fitted on the connector 20, and hence, the electric wires 23 can move freely. Thus, in case the electric wires 23 are deflected further upwards than an upper end of the guide means 24 for some reason such as an external force being applied to the electric wires 23, the electric wires 23 ride over the guide means 24, and the electric wires 23 are oriented no more in the one direction (and are then oriented in a direction that is substantially at right angles to the back surface 25 of the connector 20).

In contrast with this, as shown in FIG. 3, when the connector cover 10 is fitted on the connector 20, the electric wires 23 are caught by the guide means 24 that is deformed by the pressing means 12 and the back surface 25 of the connector 20 to thereby be restricted from moving, whereby the electric wires 23 are prevented from being deflected upwards. Thus, even though an external force is applied to the electric wires 23, the electric wires 23 that are pulled out of the connector 20 can be oriented in one direction without being deflected.

Here, the extent to which the movement of the electric wires 23 is restricted should be selected as required according to equipment to which the connector unit is applied. Specifically, any of the following states can be selected as required: a state in which the electric wires 23 are fastened strongly by the deformed guide means 24 and the back surface 25 of the connector 20; a state in which the electric wires 23 are fastened loosely by the deformed guide means 24 and the back surface 25 of the connector 20; and a state in which the guide means 24 and the back surface 25 of the connector 20 are approximately in contact with the electric wires 23.

By adopting this configuration, with the connector cover 10 attached to the connector 20, the direction of the electric wires 23 that are pulled out of the connector 20 is fixed without any deflection, thereby making it possible to orient the electric wires 23 in one direction in an ensured fashion.

Additionally, in the event that an external force is applied to the electric wires 23 for some reason after the connector cover 10 has been attached to the connector 20, compared with the conventional connector unit, the force exerted on the connecting portion between the connector and the electric wires is mitigated by the deformed guide means 24, thereby making it possible to prevent a deformation or failure of a terminal in the connector or a connection failure. This external force mitigating effect can be expected not only when the electric wires 23 are caught by the deformed guide means 24 and the back surface 25 of the connector 20 but also when the guide means 24 and the back surface 25 of the connector 20 are somehow in contact with the electric wires 23. Then, when an external force is applied to the electric wires 23, the force exerted on the connecting portion between the connector 20 and the electric wires 23 can be mitigated by a frictional force produced between the electric wires 23 and the guide means 24 or the back surface 25 of the connector 20.

Figure 4:
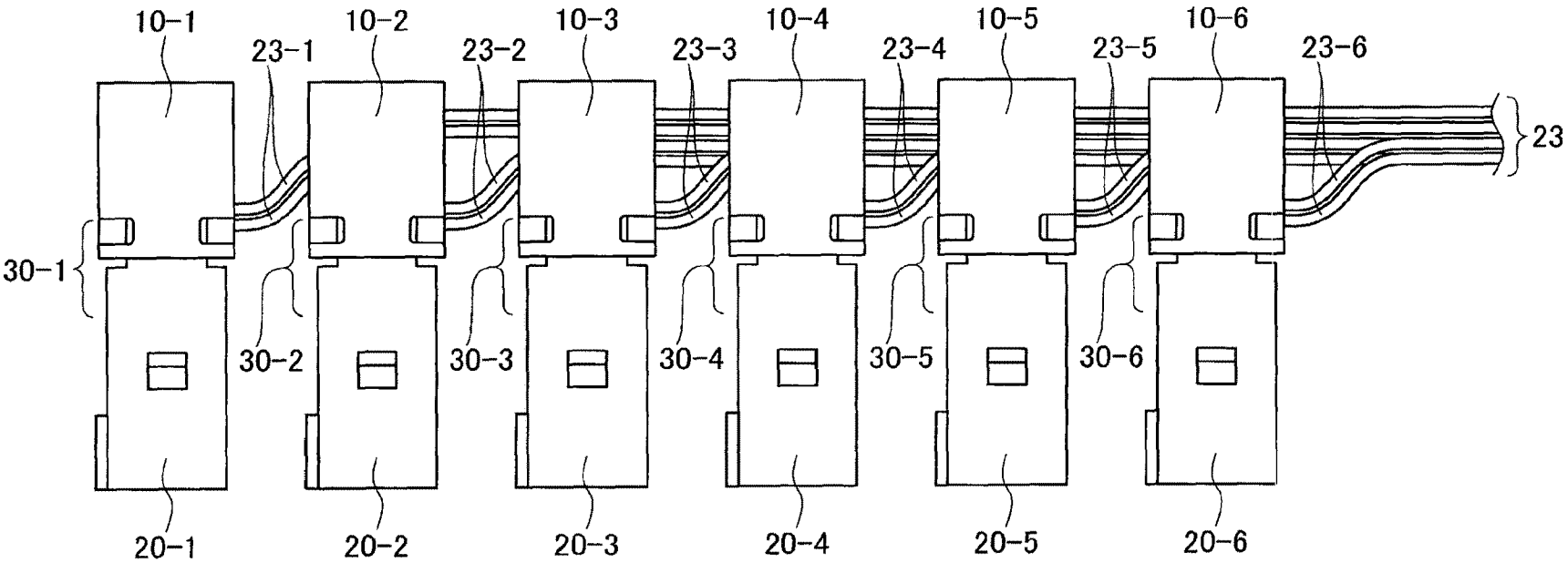
FIG. 4 is a plan view showing a plurality of connector units according to the first embodiment of the invention that are aligned side by side in a row with electric wires laid out therethrough.
Figure 5:
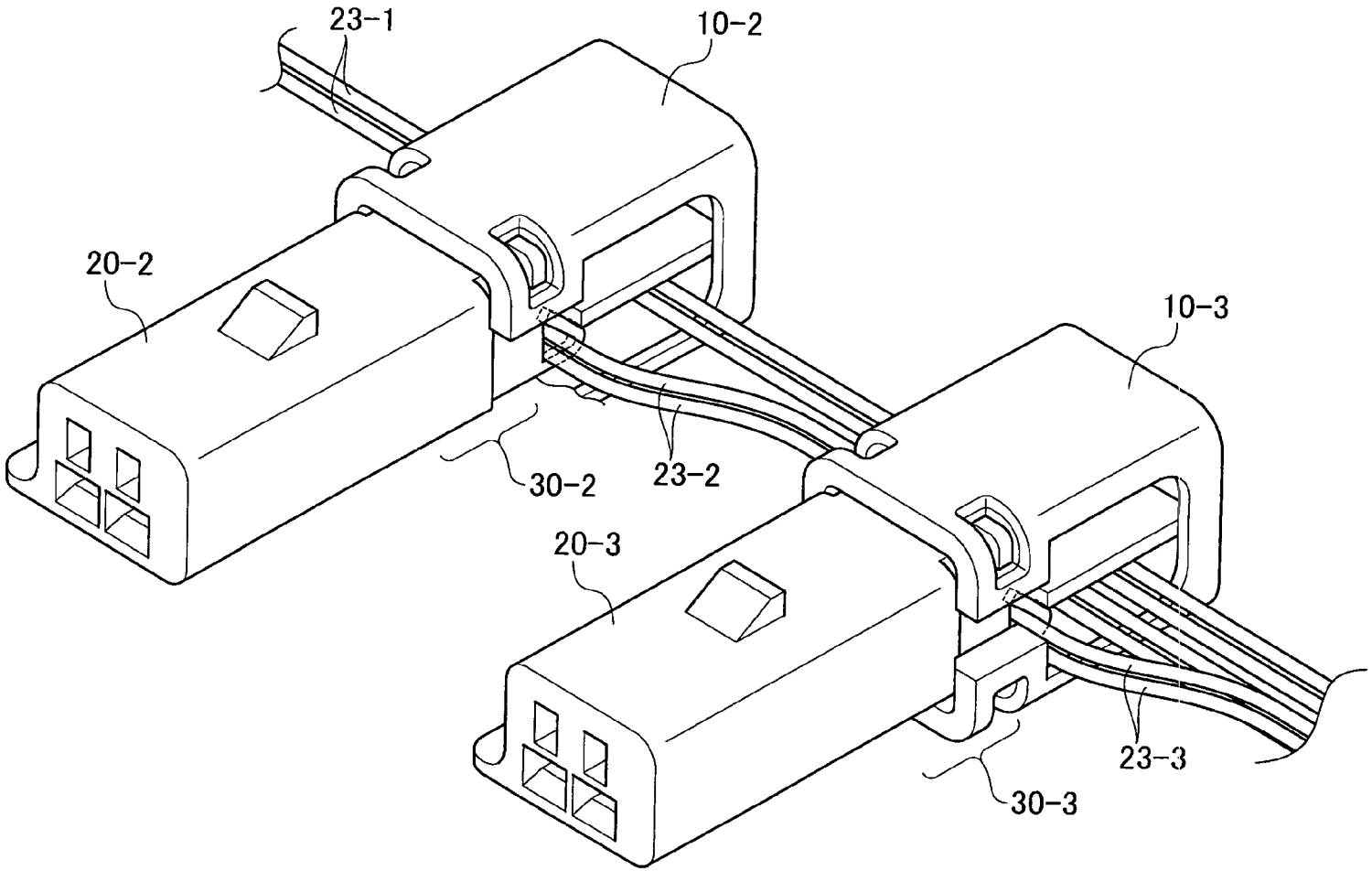
FIG. 5 is a perspective view showing part of FIG. 4 in an enlarged fashion.

An example is shown in FIGS. 4 and 5 in which a number of electric wires are laid out in one direction altogether by making use of a plurality of connector units like the connector unit of this embodiment. FIG. 4 is a view showing a state in which the plurality of connector units 30-1 to 30-6 according to the embodiments are aligned side by side and electric wires from individual connectors are guided to the outside altogether. FIG. 5 shows the connector units 30-2 and 30-3 of those shown in FIG. 4 in an enlarged fashion.

First of all, referring to FIG. 4, the leftmost connector unit 30-1 will be described.

At first, before a connector cover 10-1 is fitted on a connector 20-1 of the connector unit 30-1, electric wires 23-1 that are pulled out of the connector 20-1 are guided so as to be oriented in one direction (the direction of the connector unit 30-2) by making use of a guide means 24 (not shown) provided on the connector 20-1 as shown in FIG. 2.

Next, as shown in FIG. 3, the connector cover 10-1 is fitted on the connector 20-1 so as to deform the guide means 24 by a pressing means 12 to thereby restrict the movement of the electric wires 23-1, whereby the electric wires 23-1 are oriented in the one direction so as not to be deflected even though an external force is applied to the electric wires 23-1. Thus, the work done on the connector unit 30-1 ends.

Next, referring to FIGS. 4 and 5, the second leftmost connector unit 30-2 will be described.

At first, similar to the case with the connector unit 30-1 described just above, before a connector cover 10-2 is fitted on a connector 20-2 of the connector unit 30-2, electric wires 23-2 that are pulled out of the connector 20-2 are guided in one direction (the direction of the connector unit 30-3) by making use of a guide means 24 (not shown) provided on the connector 20-2.

Additionally, in association with the preparatory work described above, the electric wires 23-1 from the connector unit 30-1 are positioned in a space portion (the portion denoted by reference numeral 13 in FIG. 1) via a gap portion (a portion denoted by reference numeral 14 in FIG. 1) in the connector cover 10-2, so that the electric wires 23-1 are allowed to pass through the space portion.

In the state described above, the connector cover 10-2 is fitted on the connector 20-2 so as to deform a guide means 24 by a pressing means 12 to thereby restrict the movement of the electric wires 23-2 from the connector 20-2, as well as preventing the electric wires 23-1 from the connector unit 30-1 from moving out of the space portion 13. Thus, the electric wires 23-2 from the connector 20-2 are oriented in the one direction without being deflected even though an external force is applied thereto, and the electric wires 23-1 from the other connector are retained within the space portion 13 even though an external force is applied thereto so as to pass through the space portion 13 in the one direction. Then, the work to be done on the connector unit 30-2 ends.

Next, although the third leftmost connector unit 30-3 will be described, the third leftmost connector unit 30-3 is basically the same as the connector unit 30-2 described just above.

Namely, at first, before a connector cover 10-3 is fitted on a connector 20-3 of the connector unit 30-3, electric wires 23-3 that are pulled out of the connector 20-3 are guided in one direction (the direction of the connector unit 30-4) by making use of a guide means 24 (not shown) provided on the connector 20-3.

Additionally, in association with the preparatory work described above, the electric wires 23-2 from the connector unit 30-2 and the electric wires 23-1 that extend from the connector unit 30-1 via the connector unit 30-2 are positioned altogether in a space portion (the portion denoted by reference numeral 13 in FIG. 1) via a gap portion (the portion denoted by reference numeral 14 in FIG. 1) in the connector cover 10-3, so that the electric wires 23-1 and the electric wires 23-2 are allowed to pass through the space portion.

In the state described above, the connector cover 10-3 is fitted on the connector 20-3 so as to deform a guide means 24 by a pressing means 12 to thereby restrict the movement of the electric wires 23-3 from the connector 20-3, as well as preventing the electric wires 23-1 from the connector unit 30-1 and the electric wires 23-2 from the connector unit 30-2 from moving out of the space portion 13. Thus, the electric wires 23-3 from the connector 20-3 are oriented in the one direction without being deflected even though an external force is applied thereto, and the electric wires 23-1 and the electric wires 23-2 from the other connectors are retained within the space portion 13 even though an external force is applied thereto so as to pass through the space portion 13 in the one direction. Then, the work to be done on the connector unit 30-3 ends.

The operations that have been described above are executed on all the connectors 20 and the connector covers 10, whereby as shown in FIG. 4, a number of electric wires 23 can be laid out altogether in the one direction easily and in an ensured fashion.

The work to be done on each connector unit does not have to be carried out sequentially, starting with the leftmost connector unit 30-1, and hence, the connector units can be worked in an arbitrary order or simultaneously.

Next, the working effect of the embodiment will be described.

In the conventional connector unit, the electric wires are pulled straight out of the connector (substantially at right angles to the back surface of the connector), and therefore, even though the electric wires pulled out are attempted to be oriented in one direction, it has not been easy to align the electric wires neatly.

In contract with this, in the connector unit 30 according to this embodiment, the connector 20 includes the guide means 24 that guides the electric wires 23 that are pulled out of the connector 20 in one direction, and the connector cover 10 includes the pressing means 12 that presses on the guide means 24 to deform it, whereby the electric wires 23 that are guided by the guide means 24 are restricted from moving. Thus, it is possible to orient the electric wires 23 that are pulled out of the connector 20 in one direction simply and in an ensured fashion by the guide means 24 deformed by the pressing means 12. Consequently, the connector unit 30 according to this embodiment provides the following working effect. That is, the working properties in connecting the connector 20 to electronic equipment can be improved, and it is possible to prevent the electric wires 23 from getting entangled or being caught by the case easily and in an ensured fashion.

Needless to say, the connector cover 10 provides, of course, its original working effect of protecting the electric wires 23 that are pulled out of the connector 20.

Additionally, in the conventional connector unit, the force applied to the electric wires is transferred directly to the connecting portion between the connector and the electric wires, and therefore, there is a problem that there are fears that a deformation or failure of a terminal within the connector or a connection failure is called for. In contrast with this, in the connector unit 30 according to this embodiment, the force applied to the electric wires 23 is mitigated by the guide means 24, and therefore, the connector unit 30 provides the working effect of realizing the connector unit having higher reliability in which the deformation or failure of the terminal in the connector or a connection failure is difficult to occur.

In addition, in the connector unit 30 according to this embodiment, the guide means 24 projects substantially into the L-shape from the back surface (the plane of which the electric wires in the connector 20 are pulled out) 25 of the connector 20, and therefore, not only can the electric wires be guided in one direction with the simple construction in an ensured fashion, but also the guide means 24 can be formed integrally with the connector 20 in an easy fashion. Thus, the working effect is provided that the connector unit 30 with the guide means 24 can be fabricated at low cost.

Additionally, the connector unit 30 according to the embodiment includes the plurality of guide means 24-1, 24-2 that guide the electric wires 23 in different directions, and therefore, by using either or both of the guide means, the electric wires 23 can be guided to the left or right or to both the directions.

Consequently, with the connector unit 30 of this embodiment, the electric wires can be oriented in desired directions according to applications, and therefore, the connector unit 30 provides the working effect of realizing the highly versatile connector unit that can cope with various applications flexibly.

In addition, in the connector unit 30 according to this embodiment, the connector cover 10 includes the space portion 13 trough which the electric wires can pass, and therefore, electric wires from other connector units are allowed to pass through the space portion 13, whereby the electric wires from the connector in question and the electric wires from the other connectors can be aligned altogether in one direction neatly in an easy and ensured fashion. Consequently, by using the connector unit 30 according to this embodiment, the working effect is provided of laying out a number of electric wires that are pulled out of a number of connectors altogether in one direction neatly in an easy and ensured fashion.

Further, the space portion 13 is divided into two portions by the flat plate-like pressing means 12 as seen from the direction in which the electric wires pass therethrough, and therefore, compared with a case where no pressing means 12 is provided, the electric wire movable range where electric wires from other connectors are allowed to move within the space portion 13 is limited, thereby making it possible to lay out the electric wires altogether more neatly.

In this embodiment, the guide means 24 projects substantially into the L-shape from the back surface 25 of the connector 20. However, the construction of the guide means is not limited thereto, and hence, any construction can be adopted as long as the construction allows the electric wires that are pulled out of the back surface 25 of the connector 20 to be guided in a certain direction, and the construction includes a J-shape, a T-shape or the like into which the guide means 24 is formed. In addition, in this embodiment, the guide means 24 is made from the resin and is formed integrally with the connector 20. However, the invention is not limited thereto. For example, the guide means may be fabricated separately from the connector so as to be attached to the connector. As this occurs, the material is not, of course, limited to resins as long as a material used can be deformed by the pressing means.

Additionally, in this embodiment, the two electric wires are pulled out of the connector 20. However, the number of electric wires that are pulled out of the connector is not limited thereto, and hence, one or three or more electric wires may be pulled out of the connector. In this embodiment, the connector 20 is the female connector. However, it is obvious that the invention can also be applied to a male connector. In this embodiment, the two guide means 24 are provided on the back surface 25 of the connector 20. However, in case the electric wires are determined to be laid out in one direction, only one guide means should be provided. On the contrary, in case the electric wires are determined to be laid out not only in two directions but also in more other directions, three or more guide means may be provided.

In addition, in this embodiment, the pressing means 12 is the plate-like member that extends from the bottom surface 15 of the connector cover 10 to the front. However, the invention is not limited thereto, and hence, the pressing means may take any form as long as it can press on and deform the guide means so as to restrict the movement of the electric wires that are guided by the guide means when the connector cover is fitted on the connector.

Second Embodiment

Figure 8:
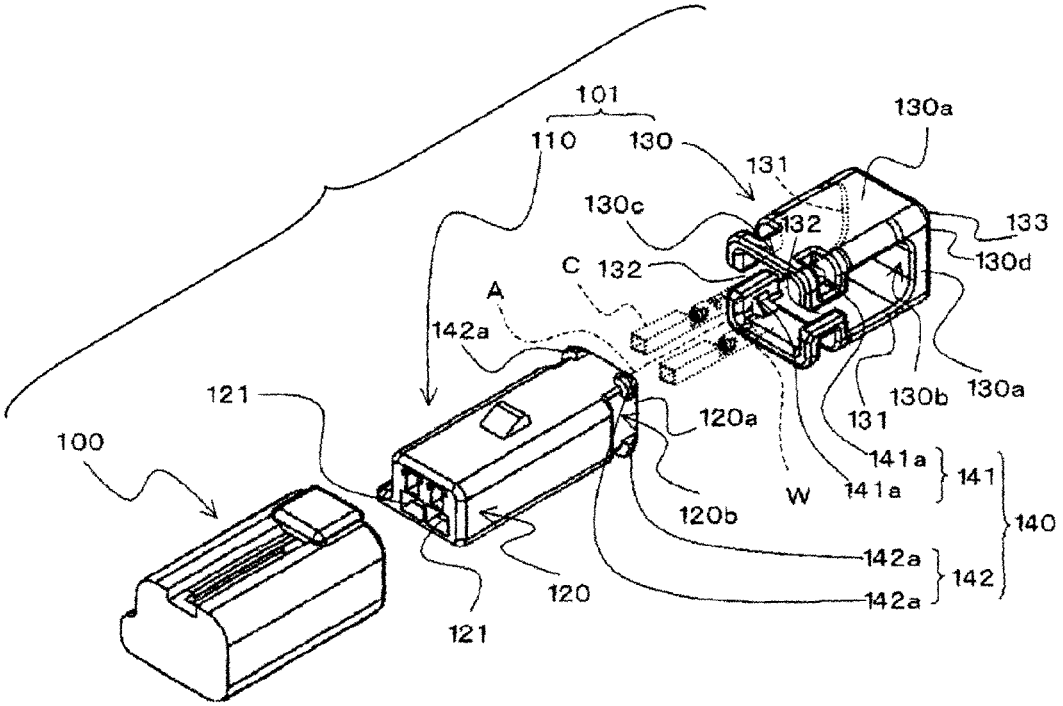
FIG. 8 is an exploded perspective view of a connector unit according to a second embodiment of the invention.
Figure 9:
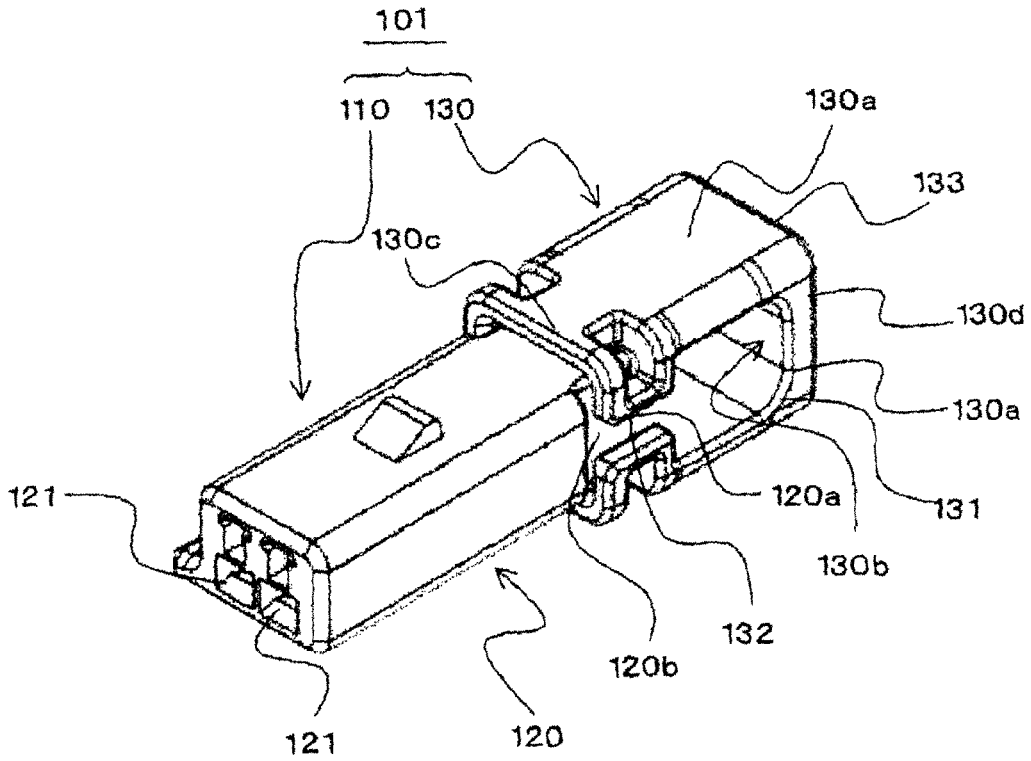
FIG. 9 is a perspective view of the connector unit shown in FIG. 8.
Figure 10A:
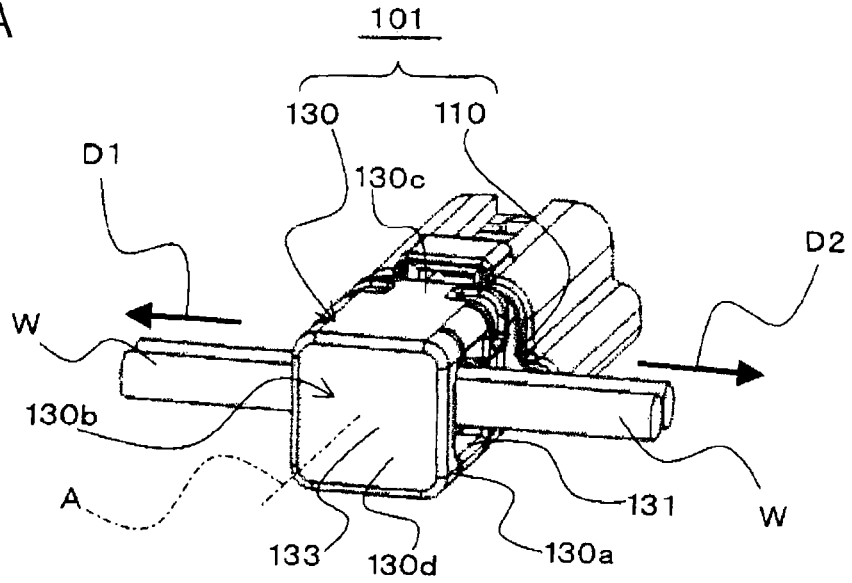
FIGS. 10A and 10B are perspective views showing the connector unit shown in FIG. 8 is connected to a mating connector.
Figure 10B:
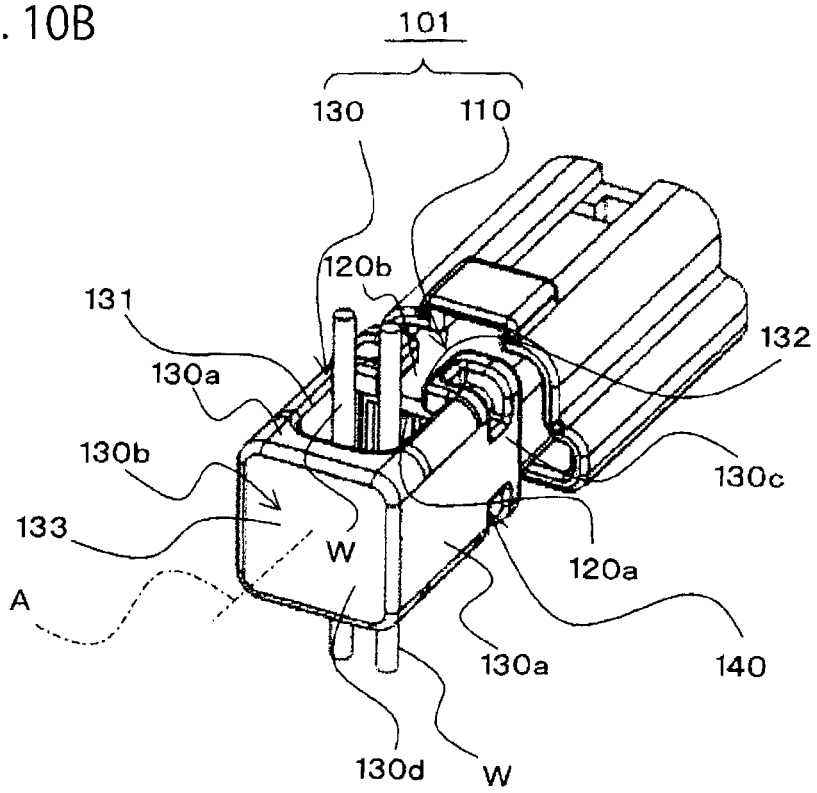

FIG. 8 is an exploded perspective view of a connector unit 101 according to a second embodiment of the invention. In FIG. 8, a perspective view of a mating connector 100 that connects to a connector 110 is shown, and electric wires W that are pulled out of the connector 110 are omitted from illustration. FIG. 9 is a perspective view of the connector unit 101 shown in FIG. 8. In FIG. 9, the electric wires W that are pulled out of the connector 110 are omitted from illustration. FIGS. 10A and 10B show perspective views showing states in which the connector unit 101 and the mating connector 100, which are shown in FIG. 8, are connected together, and FIGS. 10A and 10B show the states in which an connector cover 130 is assembled to the connector 110 with its electric wire passage openings 131 oriented in different directions.

The connector unit 101 according to the second embodiment of the invention is used for electric wires that are laid out in a vehicle or the like.

The connector unit 101 has the connector 110 and the connector cover 130. The connector 110 includes a connector housing 120 that accommodates terminals C that are attached to the electric wires W. The connector cover 130 is assembled to an electric wire pull-out opening 120*a* in the connector housing 120 so as not only to guide the electric wires W that are pulled out of the connector housing 120 in a lay-out direction but also to protect the electric wires W.

First of all, the connector 110 will be described.

The connector housing 120 is made from an insulating material such as a synthetic resin or the like and is formed substantially into a rectangular parallelepiped block. The connector housing 120 has a terminal accommodation chamber 121 that accommodates the terminals C that are attached to the electric wires W. In this embodiment, the terminals C are illustrated as being female terminals. However, the invention is not limited thereto, and hence, the terminals C may be male terminals.

In addition, an electric wire pull-out-side end portion 120*b* of the connector housing 120 which is an end portion at a side where the electric wire pull-out opening 120 is so shaped as to be fitted in an opening-side end portion 130*c* of the connector cover 130 which is an end portion at a side where the connector cover 130 is opened. This electric wire pull-out-side end portion 120*b* has an axially symmetrical shape in which an axis thereof coincides with an axis A of the connector cover 130 so that the pull-out-side end portion 120*b* can be fitted in the opening-side end portion. More specifically, an external shape of a section of the electric wire pull-out-side end portion 120*b* that is at right angles to the axis A is square so that the electric wire pull-out-side end portion 120*b* can be fitted in the opening-side end portion 130*c*.

In addition, the connector 110 is made to connect to the mating connector 100 shown in FIG. 8.

Next, the connector cover 130 will be described.

The connector cover 130 has a bottomed, axially symmetrical tubular shape. In the connector cover 130, two electric wire passage openings 131, 131 are formed in side walls 130*a* thereof, and the two electric wire passage openings 131, 131 constitute entrances or exits for electric wires W where electric wires W that are laid out from a different connector cover 130 are allowed to pass to thereby be restricted to a lay-out direction and exits for electric wires W that are pulled out of the electric wire pull-out opening 120*a* to be pulled out in the lay-out direction.

More specifically, the connector cover 130 is made of an insulating material such as a synthetic resin or the like and an external shape of a section that is at right angles to the axis A is square. The electric wire passage openings 131, 131 are formed in surfaces of the side walls 130*a* that face each other, so that electric wires W are guided in the lay-out direction by inner wall surfaces that are surrounded by the side walls 130*a* and a bottom wall 130*b*.

In addition, the connector cover 130 has two guide slits 132, 132 in the electric wire passage openings 131, 131, and the guide slits 132, 132 guide individually the electric wires W from the opening-side end portion 130*c* that is the end portion at the opening side into the two electric wire passage openings 131, 131.

In the connector cover 130, a pressing surface 133 is formed on an external surface 130*d* of a bottom wall 130*b*, and this pressing surface 133 is pressed when the connector cover 130 is attached to the connector housing.

The pressing surface 133 is formed with a surface that is at right angles to a pressing direction formed on almost a whole area of the external surface 130*d*.

Additionally, the connector unit 110 has an axial rotation locking portion 140 that locks the connector cover 130 and the connector housing 120 at a plurality of locations where the connector cover 130 is rotated about its axis relative to the connector housing 120 so as to be oriented accordingly.

The axial rotation locking portion 140 has a cover-side locking portion 141 that is provided on the connector cover 130 side and a connector-side locking portion 142 that is provided on the connector housing 120 side.

The cover-side locking portion 141 has cover-side locking projections 141*a* that are provided at four corners of the opening-side end portion 130*c* of the connector cover 130 so as to project from an inner circumferential surface.

The connector-side locking portion 142 has connector-side locking projections 142*a* that are provided at four corners of the electric wire pull-out-side end portion 120*b* so as to project from an outer circumferential surface.

The cover-side locking projections 141*a* and the connector-side locking projections 142*a* are provided in positions that correspond to each other axially symmetrically, so as to ride over the corresponding projections to thereby lock the connector cover 130 and the connector housing 120 in fitting completion positions when the electric wire pull-out-side end portion 120*b* and the opening-side end portion 130*c* are fitted together.

Here, the connector cover 130 has the bottomed tubular shape and has the two electric wire passage openings 131, 131 that constitute the entrances or exits for electric wires W where electric wires W that are laid out from a different connector cover 130 are allowed to pass to thereby be guided in a lay-out direction and exits for the electric wires W that are pulled out of the electric wire pull-out opening 120*a* to be pulled out in the lay-out direction. Therefore, when the connector covers 130 is assembled to each of a plurality of connectors 110 that are provided along the lay-out direction of electric wires W, the connector cover 130 can be assembled to the connector 110 without limiting the functions of electric wire passage openings 131, 131 to the entrances or exits for electric wires W.

Additionally, the connector cover 130 has the bottomed, axially symmetrical tubular shape, and the two electric wire passage openings 131, 131 are formed in the side walls 130*a* so as to be axially symmetrical with each other. Therefore, the direction in which the connector cover 130 is assembled to the connector housing 120 is not limited by the respective orientations of the two electric wire passage openings 131, 131.

Namely, the connector cover 130 may be assembled to the connector housing 120 with either of the two electric wire passage openings 131, 131 oriented to an connector cover 130 that lies adjacent thereto. Therefore, the connector cover 130 can be used for a plurality of connectors 110 that are provided along the lay-out direction of electric wires W.

In addition, either of the two electric wire passage openings 131, 131 may be oriented to the lay-out direction of electric wires W. Therefore, the connector cover 130 can easily be assembled to the connector housing 120.

In addition, as shown in FIG. 10, the electric wires W that are pulled out of the connector housing 120 can be passed through either of the two electric wire passage openings 131, 131 so as to be guided in either of lay-out directions (indicated by arrows D1, D2).

The external shape of the section of the connector cover 130 that is at right angles to the axis A is square, and the external shape of the section of the electric wire pull-out-side end portion 120*b* of the connector housing 120 that is at right angles to the axis A is square so as to be fitted in the opening-side end portion 130*c*. Therefore, the connector cover 130 can be locked to the connector housing 120 stably every time the connector cover 130 is rotated through 90 degrees about its axis relative to the connector housing 120.

Because of this, as shown in FIGS. 10A and 10B, the lay-out direction of electric wires W can be changed by rotating the orientation of the two electric wire passage openings 131, 131 through 90 degrees.

Next, by using FIGS. 11 to 15, a procedure of attaching connector covers 130 to a plurality of connector housings 120 in laying out electric wires W will be described.

Figure 11A:
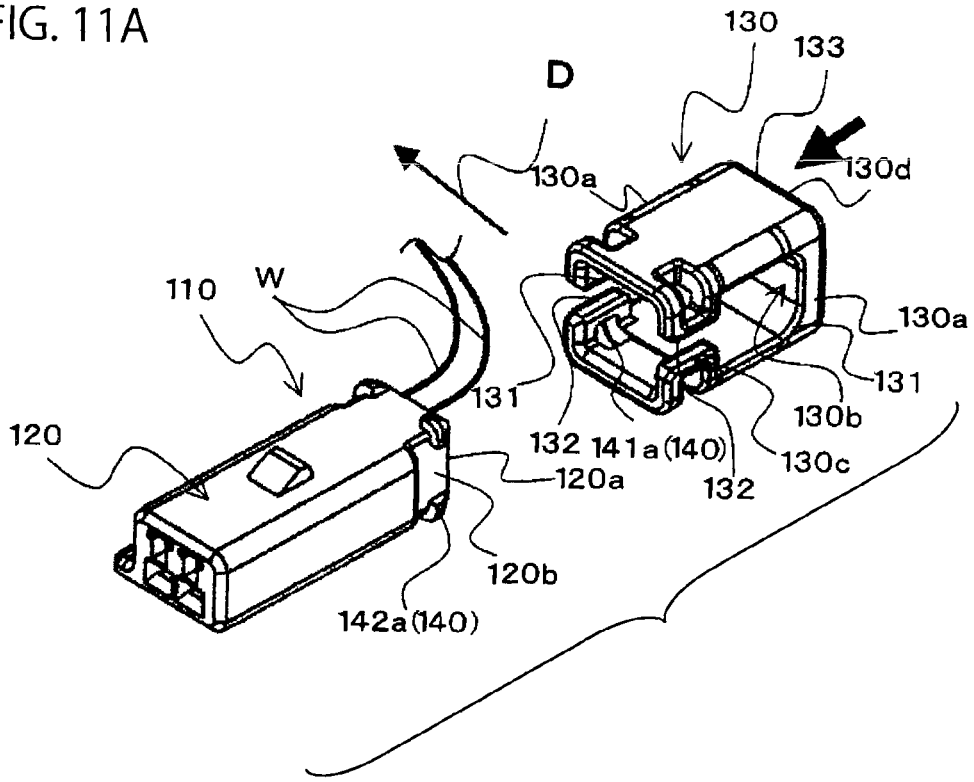
FIGS. 11A and 11B are views showing a procedure of attaching connector covers to a plurality of connector housings.
Figure 11B:
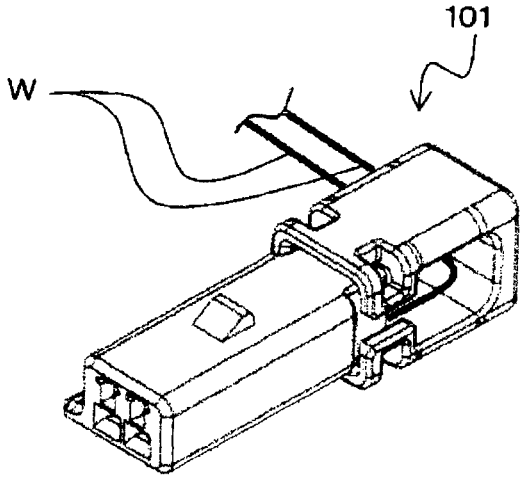
Figure 12A:
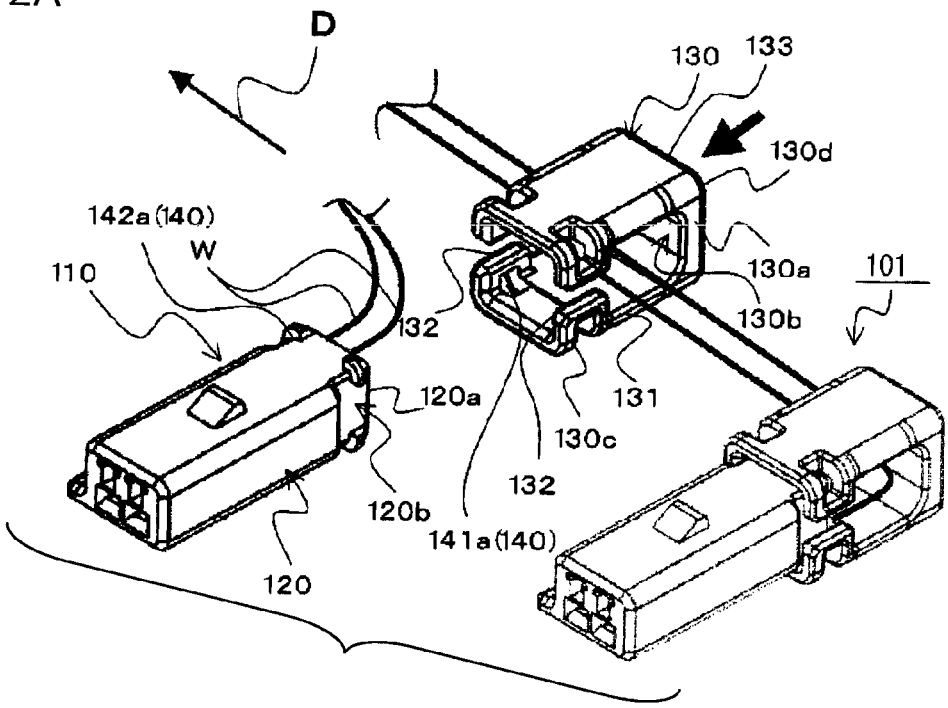
FIGS. 12A and 12B are views showing the procedure of attaching the connector covers to the plurality of connector housings.
Figure 12B:
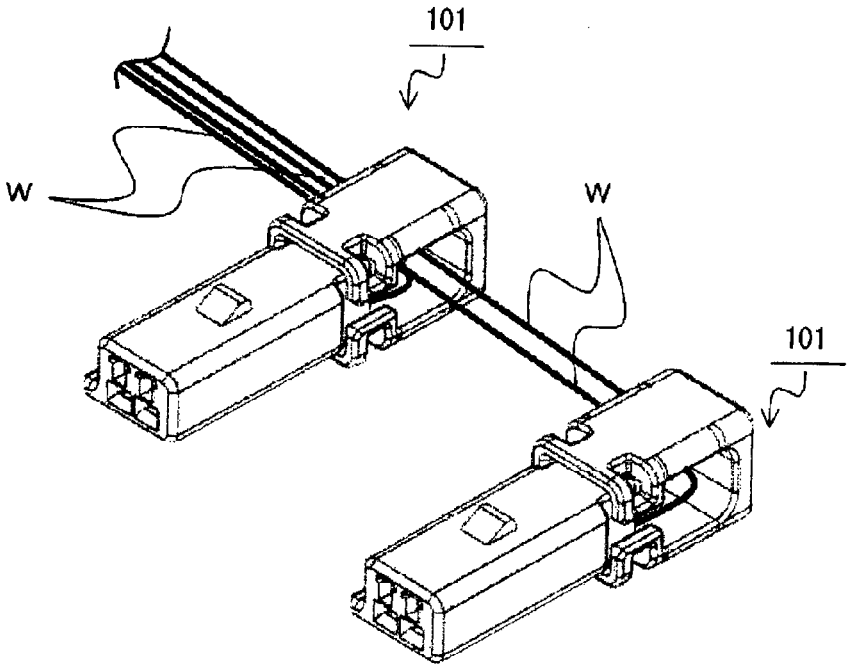
Figure 13:
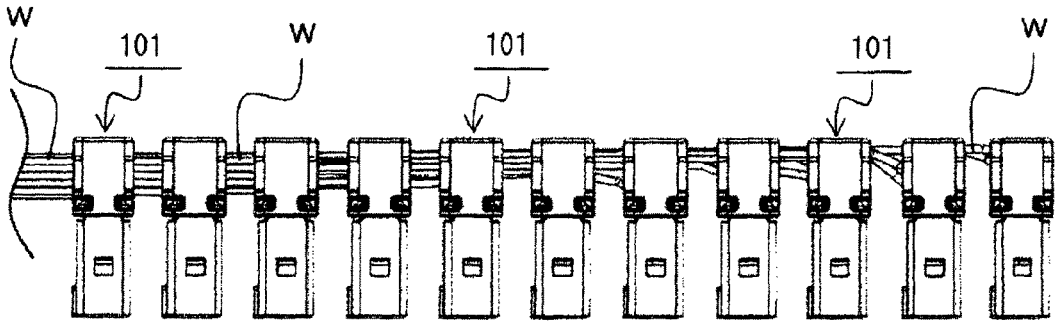
FIG. 13 is a view showing the procedure of attaching the connector covers to the plurality of connector housings.
Figure 14:
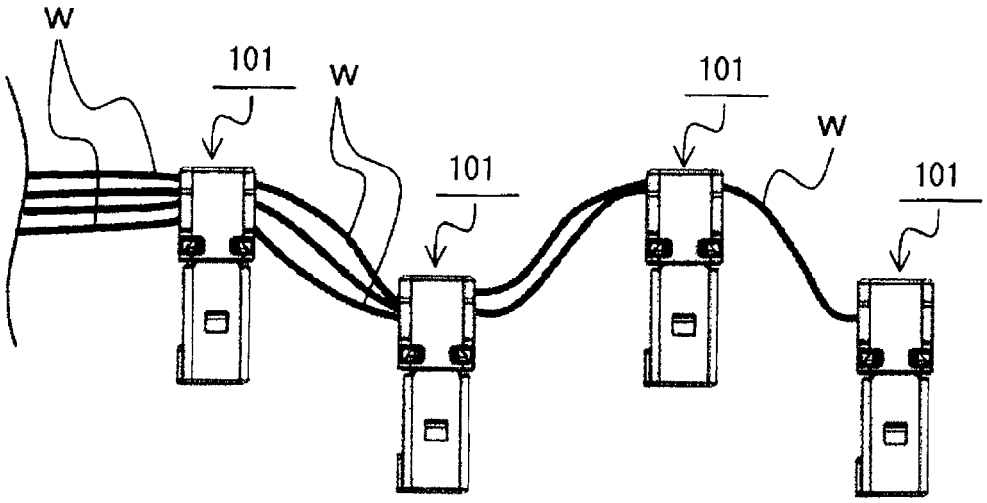
FIG. 14 is a view showing a plurality of connectors that are not aligned in a straight line.
Figure 15:
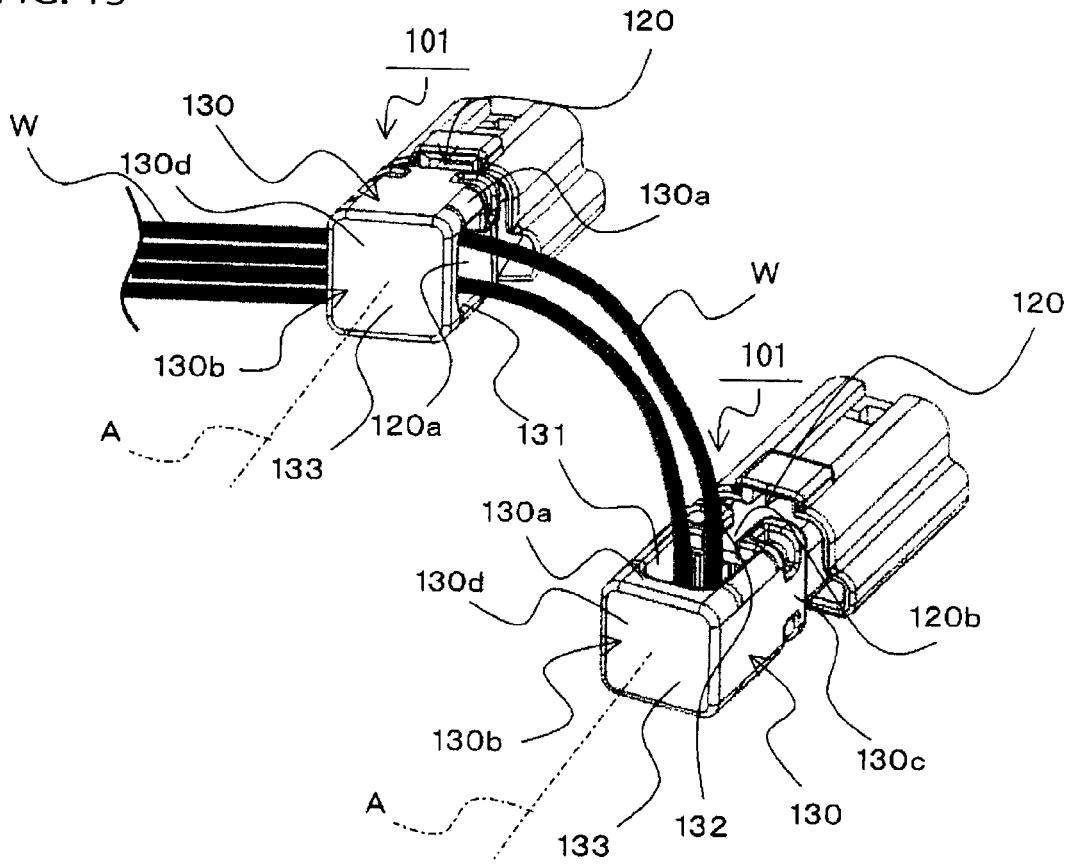
FIG. 15 is a view showing an example of an electric wires layout using in combination an connector covers 130 that is rotated through 90 degrees relative to a connector housing.

FIGS. 11 to 13 are views showing a procedure of attaching connector covers 130 to a plurality of connector housings 120. FIG. 14 is a view showing a state in which a plurality of connectors 110 are not aligned in a straight line. FIG. 15 is a view showing an example of an electric wires layout using in combination an connector cover 130 that is rotated through 90 degrees relative to a connector housing 120.

In this description of the procedure, electric wires W will be described as being laid out through the plurality of connectors 110 which are aligned in a straight line.

First of all, the working person assembles an connector cover 130 to a connector housing 120 in such a way that electric wire passage openings 131 are oriented in a lay-out direction of electric wires W (indicated by an arrow D in FIG. 11) relative to a connector 110 (refer to FIGS. 11A, B).

In this assembling work, the connector cover 130 is assembled to the connector housing 120 while pulling out electric wires W that are pulled out of the connector housing 120 in the lay-out direction through one electric wire passage opening 131 of the connector cover 130 which functions as an exit for the electric wires W.

In addition, in this assembling work, the connector cover 130 can easily be assembled to the connector housing 120 in such a way that the electric wires W that are pulled out of the connector housing 120 are guided into the individual electric wire passage openings 131, 131 from corresponding guide slits 133, 132.

Additionally, the connector cover 130 should be assembled to the connector housing 120 with either of the two electric wire passage openings 131, 131 oriented in the lay-out direction of the electric wires W (indicated by the arrow Din FIG. 11).

Here, the connector cover 130 is attached to the connector housing 120 with the electric wires W that are pulled out of the connector housing 120 bent in such a way as to be pulled out of the electric wire passage opening 131 facing the lay-out direction. As this occurs, the connector cover 130 can easily be attached by pressing a pressing surface 133 in a fitting direction.

By performing the series of operations, the electric wires W that are pulled out of the connector housing 120 are bundled up and guided in the lay-out direction by the connector cover 130.

Thereafter, the working person assembles an connector cover 130 to a connector housing 120 in such a way that electric wire passage openings 131 are oriented in the lay-out direction of electric wires W relative to another connector 110 that is lined up along the lay-out direction of electric wires W (refer to FIGS. 12A, 12B).

In this assembling work, too, the connector cover 130 is assembled to the connector housing 120 while pulling out electric wires W that are pulled out of the connector housing 120 in the lay-out direction through one electric wire passage opening 131 of the connector cover 130 which functions as an exit for the electric wires W.

In addition, in this assembling work, too, the connector cover 130 can easily be assembled to the connector housing 120 in such a way that the electric wires W that are pulled out of the connector housing 120 are guided into the individual electric wire passage openings 131, 131 from corresponding guide slits 132, 132.

Further, here, too, similar to the assembling work described above, the connector cover 130 should be assembled to the connector housing 120 with either of the two electric wire passage openings 131, 131 oriented in the lay-out direction of the electric wires W (indicated by the arrow D in FIG. 11).

Here, the connector cover 130 is attached to the connector housing 120 with the electric wires W that are pulled out of the connector housing 120 bent in such a way as to be pulled out of the electric wire passage opening 131 facing the lay-out direction and the electric wires W that are pulled out of the other connector cover 130 that has already been assembled to the other connector housing 120 passed through the current connector cover 130 from one electric wire passage opening 131 to the other electric wire passage opening 131.

One electric wire passage opening 131 of the connector cover 130 functions as an entrance for the electric wires W that are pulled out of the other connector cover 130, and the other electric wire passage opening 131 functions as an exit for the electric wires W that are pulled out of the connector cover 130.

Here, too, the connector cover 130 can easily be attached by pressing a pressing surface 133 in a fitting direction.

By repeating the series of operations to assemble the connector covers 130 to the plurality of connectors 110 that are aligned along the lay-out direction of electric wires W, the electric wires W can be bundled up and guided in the lay-out direction (refer to FIG. 13).

In this procedure, the electric wires W are described as being laid out through the plurality of connectors 110 that are aligned in the straight line. However, the invention is not limited thereto, and hence, as shown in FIG. 14, a plurality of connectors 110 do not have to be aligned in a straight line.

Additionally, as shown in FIG. 15, electric wires W may be laid out by using in combination an connector cover 130 that is rotated through 90 degrees relative to a connector housing 120.

In the connector unit 101 of this embodiment, the connector cover 130 has the bottomed tubular shape, and the two electric wire passage openings 131, 131 are formed in the side walls 130*a* of the connector cover 130, the two electric wire passage openings 131, 131 constituting the entrance or the exit for the electric wires W that are laid out from the other connector cover 130 to be allowed to pass therethrough to be guided in the lay-out direction and also the exit from which the electric wires W from the electric wire pull-out opening 120*a* are pulled out in the lay-out direction. When the connector covers 130 are assembled to the plurality of connecters 110 that are provided along the lay-out direction of electric wires W, the connector covers 130 can be assembled to the connectors 110 without limiting the functions of the electric wire passage openings 131, 131 to an entrance or an exit for the electric wires W. Therefore, the connector covers 130 can be assembled to the plurality of connectors 110 that are provided along the lay-out direction of the electric wires W.

Additionally, in the connector unit 101 according to this embodiment, the connector cover 130 is axially symmetrical, and the electric wire pull-out-side end portion 120*b* that is the end portion at the side facing the electric wire pull-out opening 120*a* has the axially symmetrical shape in which the axis of the electric wire pull-out-side end portion 120*b* coincides with the axis A of the opening-side end portion 130*c*, enabling the electric wire pull-out-side end portion 120*b* to fit into the opening-side end portion 130*c*. Therefore, the direction in which the connector cover 130 is assembled to the connector housing 120 is not limited by the respective orientations of the two electric wire passage openings 131, 131. Namely, the connector cover 130 may be assembled to the connector housing 120 with either of the two electric wire passage openings 131, 131 oriented to an connector cover 130 that lies adjacent thereto, thereby making it possible to assemble the connector cover 130 to the connector 110 easily.

In the connector unit 101 according to this embodiment, the axial rotation locking portion 140 locks the connector cover 130 and the connector housing 120 at the plurality of locations where the connector cover 130 is rotated about the axis thereof relative to the connector housing 120 so as to be oriented accordingly. Therefore, it is possible to deal with various lay-out directions of electric wires W.

In the connector unit 101 according to this embodiment, the external shape of the section of the connector cover 130 that is at right angles to the axis A is square, and the external shape of the section of the connector housing 120 that is at right angles to the axis thereof so that the electric wire pull-out-side end portion 120*b* can fit in the opening-side end portion 130*c* is square. Therefore, it is possible to lock the connector cover 130 and the connector housing 120 stably every time the connector cover 130 is rotated through 90 degrees about the axis thereof relative to the connector housing 120.

Modified Example

Figure 16:
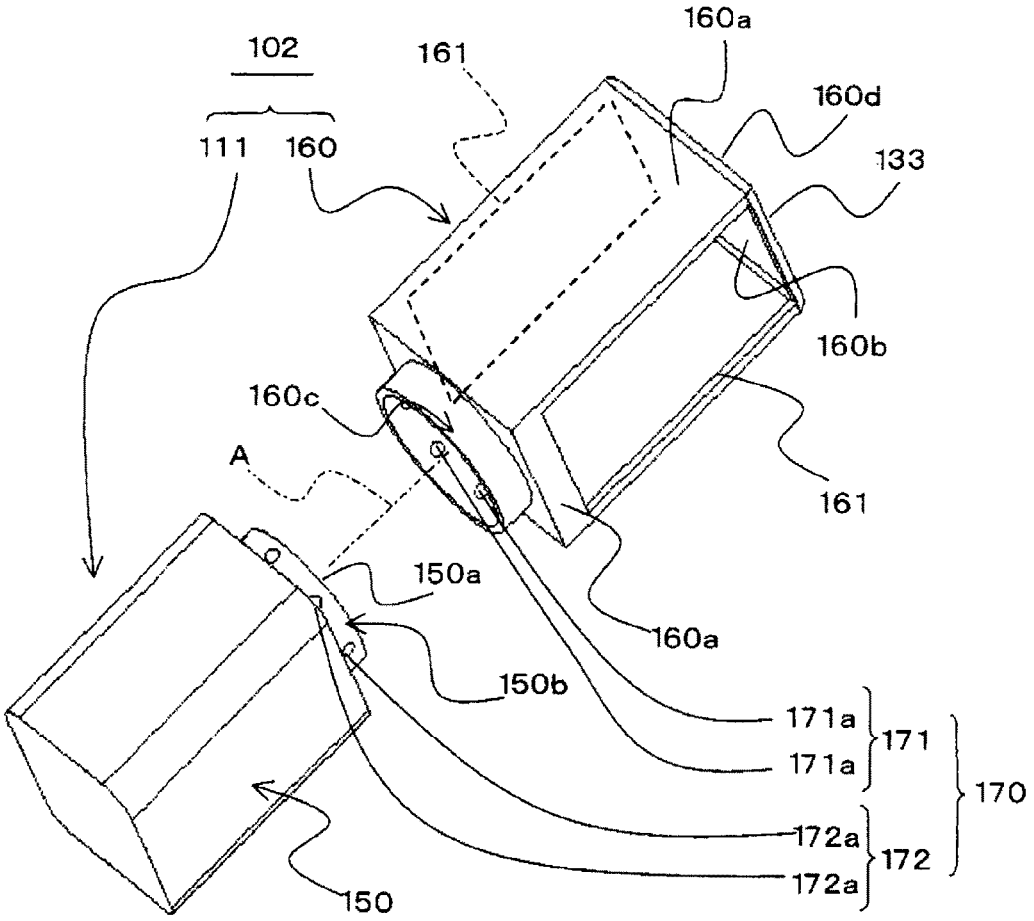
FIG. 16 is an exploded perspective view of a connector unit according to a modified example made to the connector unit.
Figure 17A:
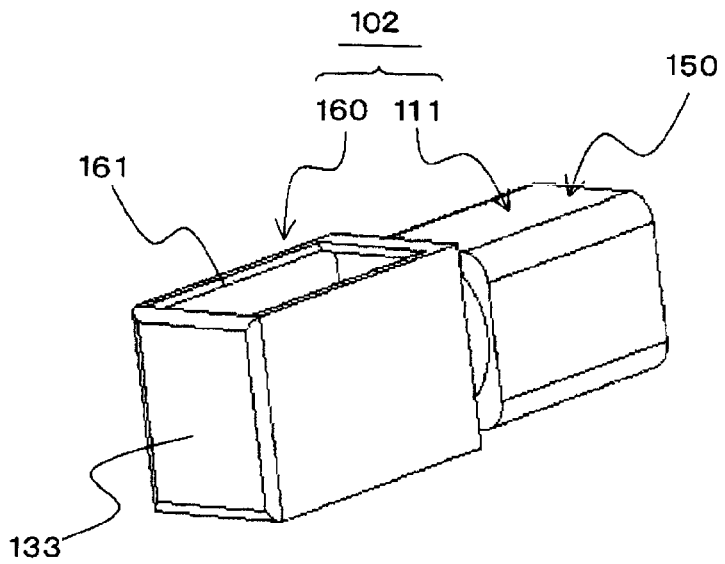
FIGS. 17A and 17B are perspective views of the connector unit showing an connector cover being attached to a connector housing while being oriented in different directions about an axis of the connector housing.
Figure 17B:
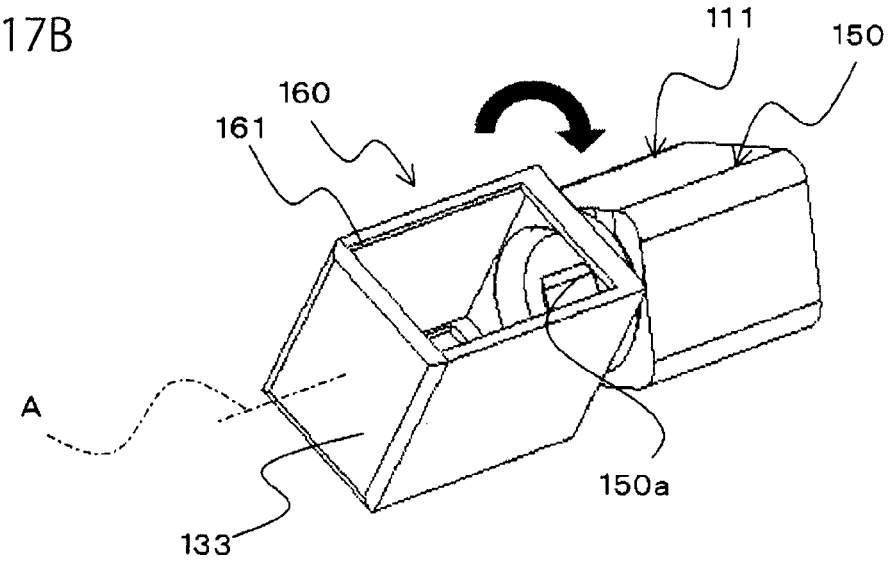

Next, by using FIGS. 16 and 17, a modified example will be described which is made to the connector unit 101 according to the embodiment described above. FIG. 16 is an exploded perspective view of a connector unit 102 that is a modified example made to the connector unit 101 according to the embodiment above. FIGS. 17A and 17B are perspective views of the connector unit 102 showing an connector cover 160 being attached to a connector housing 150 while being oriented in different directions about an axis of the connector housing 150.

The connector unit 102 of this modified example differs from the connector unit 101 in that an external shape of a section of an opening-side end portion 160*c* that is at right angles to an axis A thereof is circular and that an external shape of a section of an electric wire pull-out-side end portion 150*b* that is at right angles to the axis A so that the electric wire pull-out-side end portion 150*b* can fit in the opening-side end portion 160*c* is circular.

The other configurations are similar to those of the second embodiment, and hence, like reference numerals are given to like constituent portions to those of the embodiment.

The connector unit 102 has an axial rotation locking portion 170 that locks the connector cover 160 and the connector housing 150 at a plurality of locations where the connector cover 160 is rotated about the axis thereof so as to be oriented accordingly.

The axial rotation locking portion 170 has a cover-side locking portion 171 that is provided on the connector cover 160 side and a connector-side locking portion 172 that is provided on the connector housing 150 side.

The cover-side locking portion 171 has a plurality of cover-side locking projecting portions 171*a* that are provided at equal intervals along an inner circumferential surface of the opening-side end portion 160*c* of the connector cover 160 so as to project therefrom.

The connector-side locking portion 172 has connector-side concave locking recess portion 172*a* that are provided at equal intervals along an outer circumferential surface of the electric wire pull-out-side end portion 150*b* so as to allow the cover-side locking projecting portions 171*a* to fit therein.

The cover-side locking projecting portions 171*a* and the connector-side locking recess portions 172*a* are provided in positions that correspond to each other axially symmetrically, so that when the electric wire pull-out-side end portion 150*b* and the opening-side end portion 160*c* are fitted together, the fitting of the two members is locked by the projections and the recesses.

Here, the external shape of the section of the opening-side end portion 160*c* that is at right angles to the axis A thereof is circular and the external shape of the section of the electric wire pull-out-side end portion 150*b* that is at right angles to the axis A so that the electric wire pull-out-side end portion 150*b* can fit in the opening-side end portion 160*c* is circular. Therefore, the connector cover 160 is made to be fixed to the connector housing 150 every time the connector cover 160 is rotated through a predetermined angle about the axis thereof relative to the connector housing 150.

Because of this, as shown in FIG. 17, the lay-out direction of electric wires can be changed by rotating the connector cover 160 through a predetermined angle so as to orient two electric wire passage openings 161, 161 in a desired orientation.

The connector unit 102 according to the modified example provides a similar advantage to that provided by the connector unit 101. Additionally, the external shape of the section of the opening-side end portion 160*c* that is at right angles to the axis A thereof is circular and the external shape of the section of the electric wire pull-out-side end portion 150*b* that is at right angles to the axis A so that the electric wire pull-out-side end portion 150*b* can fit in the opening-side end portion 160*c* is circular. Therefore, the connector cover 160 can rotate about the axis thereof relative to the connector housing 150 with a certain degree of freedom in rotational angle.

Although the connector unit 101 is described as having the axially symmetrical connector cover 160, the invention is not limited thereto, and hence, the connector cover may take any form as long as it has a bottomed tubular shape. For example, there will be no problem even though an connector cover is adopted in which an external shape of a section in question is rectangular.

Thus, the embodiments of the invention have been described in detail by the use of the drawings. However, the embodiments only show the examples of the invention, and hence, the invention is not limited to the embodiments described above but can be modified, improved or the like as required. In addition, the materials, shapes, dimensions, numbers, and locations of the constituent elements are arbitrary and are not limited to those described in the embodiments, provided that the invention can be attained.

Third Embodiment

Hereinafter, the third embodiment of the invention will be described by reference to FIGS. 18 to 23.

Figure 18:
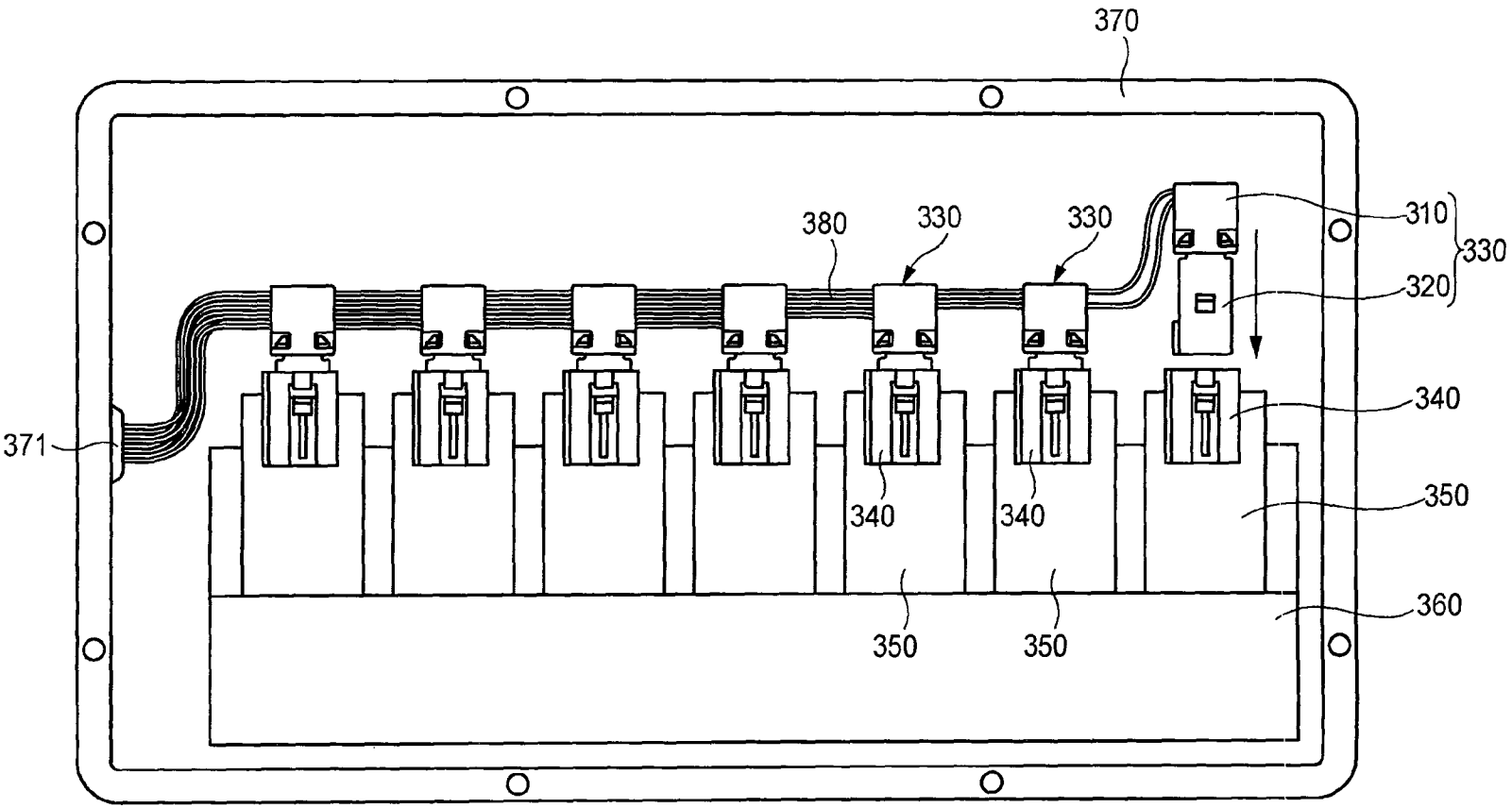
FIG. 18 is a plan view showing schematically an example of a layout of electric wires within a transmission case when connector units according to a third embodiment of the invention are used.

FIG. 18 is a plan view showing an example of a layout of electric wires within a transmission case when connector units according to the third embodiment of the invention are used. In this embodiment, as shown in FIG. 18, a rectangular transmission case 370 accommodates therein a base member 360 to which electronic parts or the like are fixed, a plurality of (seven in this embodiment) solenoids 350 that are fixed to the base member 360, mating connectors 340 (for example, male connectors) that are fixed individually to respective side surfaces of the solenoids 350, connectors 320 (for example, female connectors) that fit individually to the mating connectors 340, and electric wires 380 that are pulled out of each connector 320 to extend to a pull-out opening 371 to thereby be guided to the outside from the pull-out opening 371. The electric wires 380 include branch wires 381 that are pulled out of each connector 320 and trunk wires 382 that are each a bundle of branch wires 381 (refer to FIG. 21, which will be described later). Branch wires 381 and trunk wires 382 are guided in a direction in which they are laid out by a connector unit 330 that includes the connectors 320 and a connector cover 310 that is attached to the connector 320. The transmission case 370 is covered fluid-tightly by a separate cover, not shown. Then, oil is poured to fill an interior space that is surrounded by the transmission case 370 and the cover.

Figure 19:
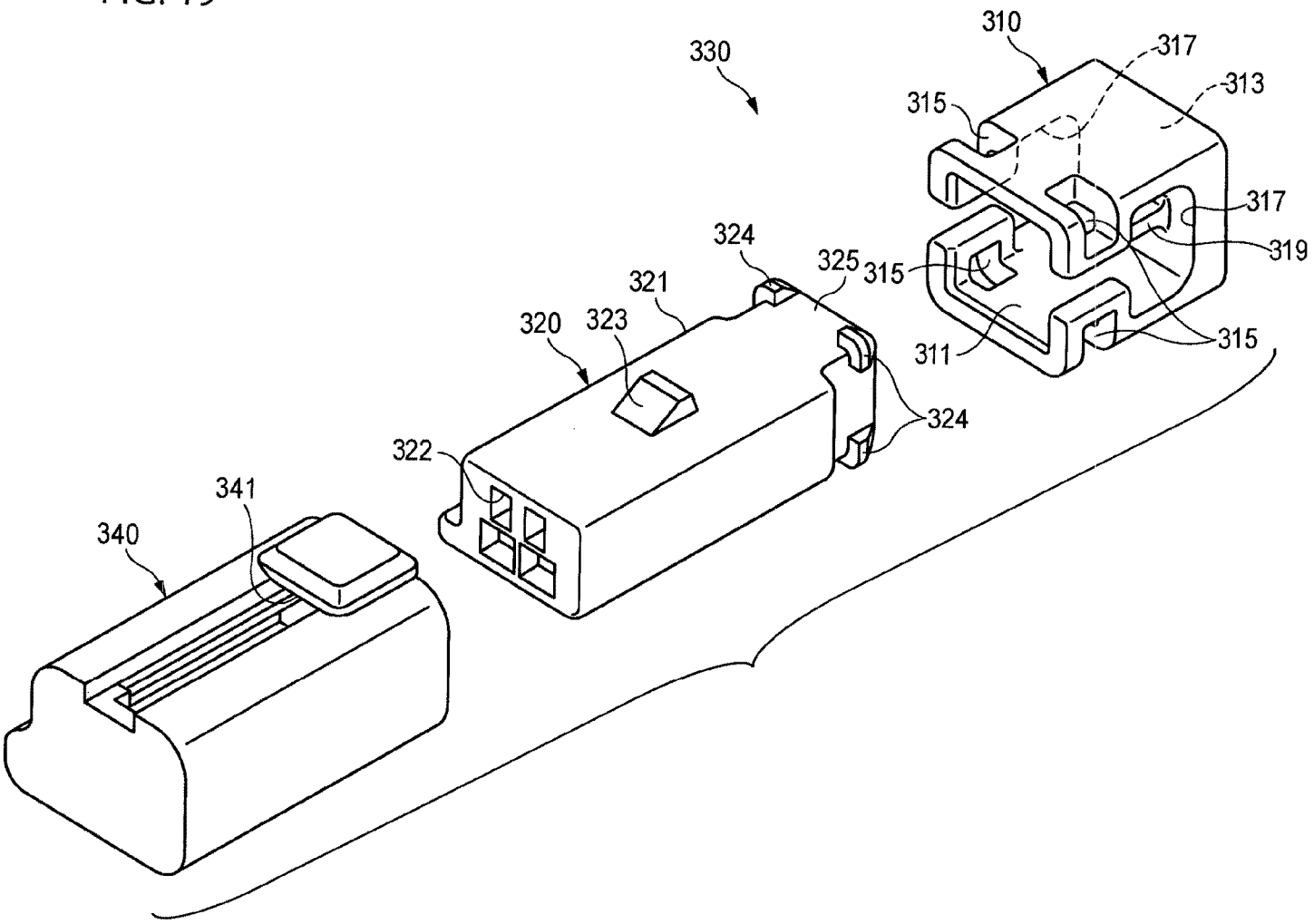
FIG. 19 is an exploded perspective view showing the connector unit and a male housing that are shown in FIG. 18.
Figure 20:
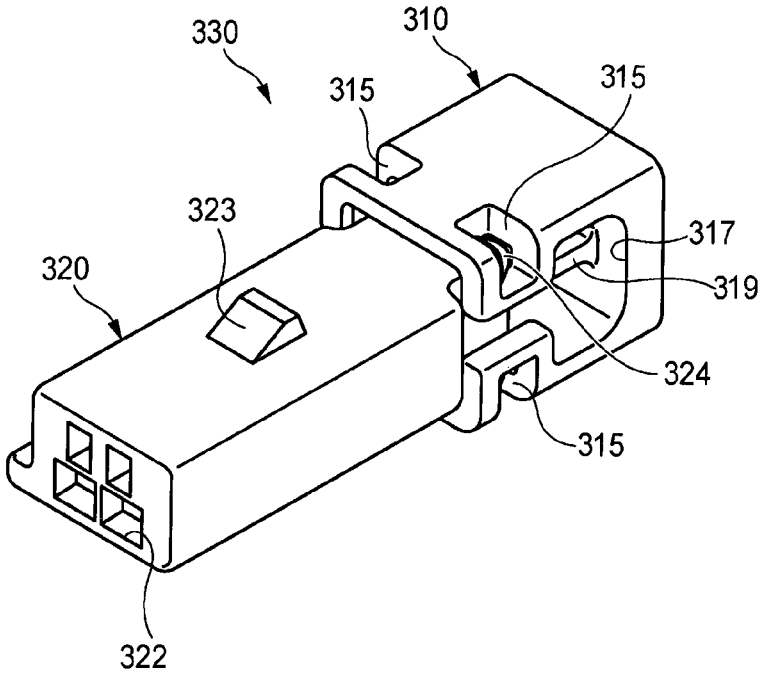
FIG. 20 is a perspective view showing the connector unit with a connector cover assembled thereto.
Figure 21:
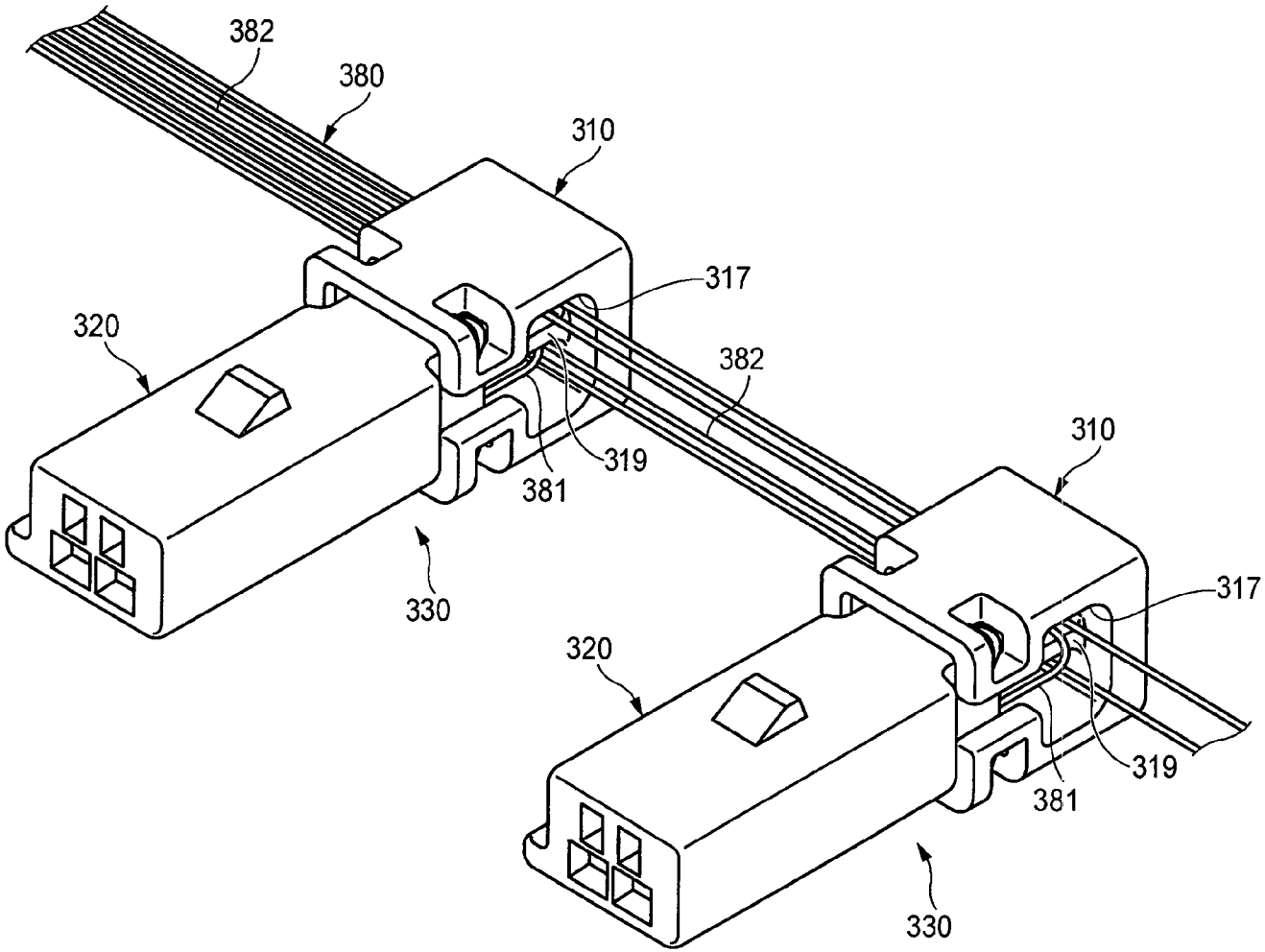
FIG. 21 is a perspective view showing a state in which the connector units are in use.
Figure 22A:
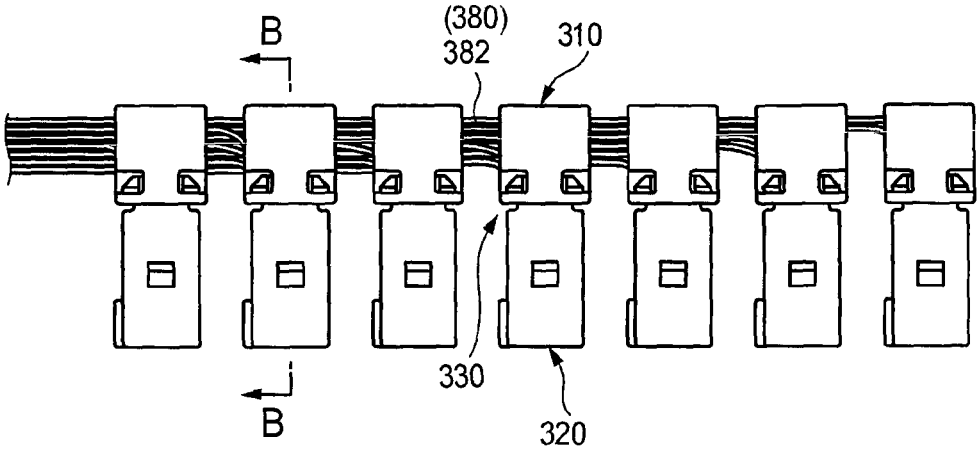
FIG. 22A is a plan view showing a state in which the connector units are in use.
Figure 22B:
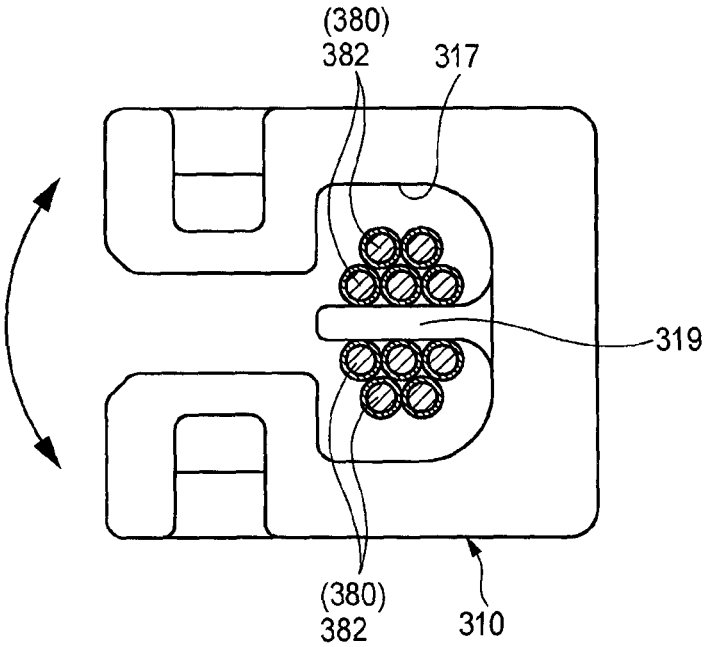
FIG. 22B is a view depicting a layout of electric wires along a line B-B in FIG. 22A with the electric wires shown in section.
Figure 23A:
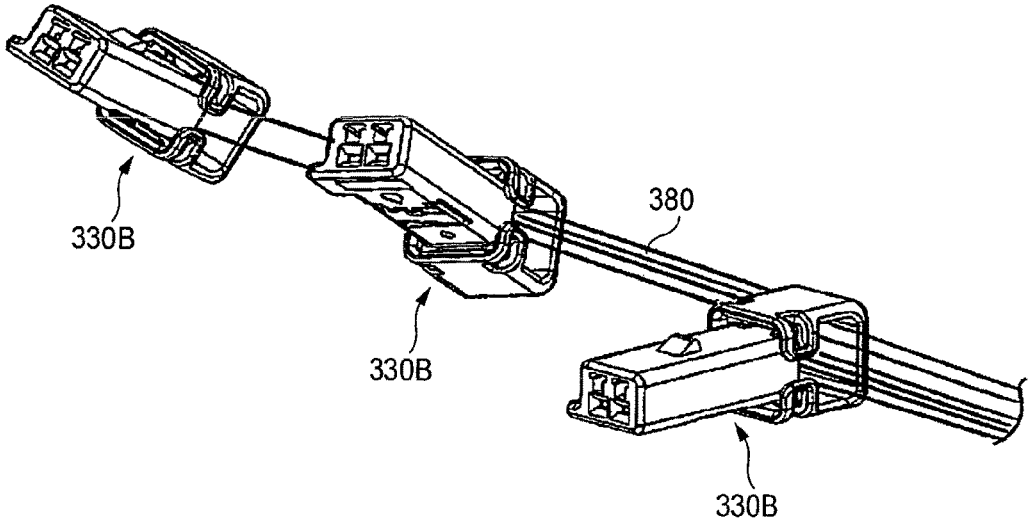
Figure 23B:
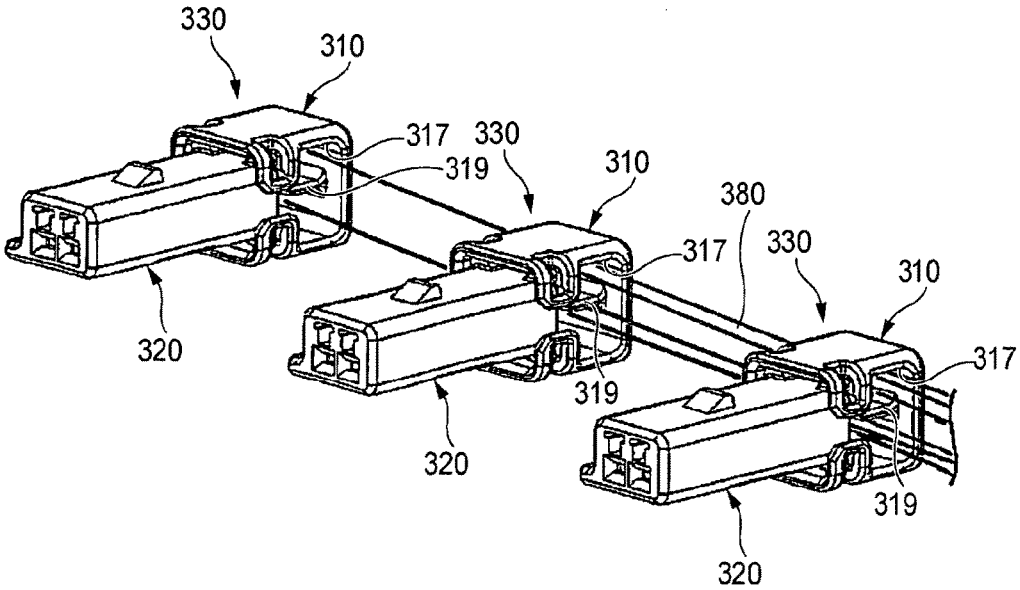

The connector unit 330 will be described. FIG. 19 is an exploded perspective view showing the connector unit and a male housing that are shown in FIG. 18, FIG. 20 is a perspective view showing the connector unit with a connector cover assembled thereto, and FIG. 21 is a perspective view showing a state in which the connector units are in use. FIG. 22A is a plan view showing a state in which the connector units are in use, and FIG. 22B is a view depicting a layout of electric wires along a line B-B in FIG. 22A with the electric wires shown in section. FIGS. 23A and 23B show perspective views depicting working effects of the connector unit according to the third embodiment of the invention, in which FIG. 23A is a perspective view showing an example of a layout form of electric wires when connector units of the earlier invention are used, and FIG. 23B is a perspective view showing an example of a layout form of electric wires when the connector units according to the third embodiment of the invention are used.

As shown in FIG. 19, the connector unit 330 includes the connector 320 of which branch wires 381 are pulled out and the connector cover 310 that is assembled to a pull-out plane 325 of the connector 320 where the branch wires 381 are pulled out. These members are all formed from a synthetic resin.

The connector 320 (for example, a female connector) includes a box-like housing 321 in an interior of which terminal accommodation compartments 322 are formed, and a plurality of terminals (for example, female terminals, not shown) electrically connected to distal ends of the branch wires 381 are accommodated in the terminal accommodation compartments 322. The connector 320 has a locking projecting portion 323 adapted to be locked in a locking portion 341 of the mating connector 340 (for example, a male connector) on an external surface of the housing 321 and fits into the mating connector 340. A plurality of mating terminals (for example, male terminals, not shown) are accommodated in an interior of the mating connector 340 for electrical connection with the terminals in the connector 320. Then, when the connector 320 fits into the mating connector 340, both the terminals are electrically connected together.

Additionally, four locking projections 324 adapted to be locked individually in locking holes 315 in the connector cover 310, which will be described later, are formed on the external surface of the housing 321 in positions lying around the pull-out plane 325. The locking projections 324 are formed in the same shape at four corners of the housing 321 at an end where the pull-out plane 325 is present. These four locking projections 324 can be locked in all the four locking holes 315 in the connector cover 310, whereby an attaching angle of the connector cover 310 to the connector 320 can be changed. Namely, the connector cover 310 can be attached to the connector 320 at an attaching angle other than an attaching angle shown in FIGS. 19 to 21, and hence, the connector cover 310 can be attached to the connector 320 in such a state that the connector cover 310 is turned by 90 degrees from the attaching angle shown (that is, the connector cover 310 is oriented both vertically and horizontally). The guiding direction of the electric wires 380 by the connector cover 310 can be changed by changing the attaching angles.

As shown in FIG. 19, the connector cover 310 is formed into the shape of a bottomed tube that has a bottom wall 313 and four side walls and has an opening 311. As shown in FIG. 20, the connector cover 310 is assembled to the end of the connector housing 321 where the pull-out plane 325 is present from the end where the opening 311 is present. The locking holes 315 adapted to be locked on the locking projections 324 are formed in four corners of the end of the connector cover 310 where the opening 311 is present. Additionally, the connector cover 310 has electric wire passage openings 317 that are formed in the side surfaces that face each other and a turn restricting projection 319 that is formed on the bottom wall 313. As shown in FIG. 22B, the turn restricting projection 319 is formed so as to extend from the bottom wall 313 towards the opening 311. In this embodiment, the turn restricting projection 319 is formed on the bottom wall 313 so as to extend perpendicularly therefrom.

Next, an electric wire laying method used for the connector unit 330 will be described. In this embodiment, the electric wire laying method will be described by taking an example as shown in FIG. 22A in which seven connector units 330 are used to restrict a layout path of the electric wires 380 so that the connector units 330 can sequentially be fitted in the mating connectors 340 that are fixed to the seven solenoids 350 shown in FIG. 18.

As shown in FIG. 21, when the connector unit 330 is used, trunk wires 382 are passed through the electric wire passage openings 317 of the connector cover 310, and branch wires 381 that are guided out of the connector 320 are pulled out of the electric wire passage opening 317. Namely, as shown in FIG. 21, trunk wires 382 from an adjacent connector unit 330 are passed through the electric wire passage openings 317 to thereby pass through an interior of the connector cover 310. Then, the trunk wires 382 and the branch wires 381 that are pulled out of the electric wire passage opening 317 are combined together into trunk wires 382 that are distributed to the next connector unit 330. In this way, in the connector unit 330, the direction in which the branch wires 381 and the trunk wires 382 are laid out is guided by the connector cover 310.

By laying out the electric wires 380 sequentially in the way described above, the branch wires 381 and the trunk wires 382 are guided appropriately to their layout direction as shown in FIG. 22A to thereby restrict the layout path thereof.

In addition, in the electric wire layout form that uses the connector unit 330 according to this embodiment, the connector cover 310 has the turn restricting projection 319. As shown in FIG. 22B, the electric wires 380 are laid out on both one side (an upper side in FIG. 22B) and the other side (a lower side in FIG. 22B) of the turn preventing projection 319. In other words, the electric wires 380 are laid out so that the electric wires 380 lie on both the one side and the other side of the turn restricting projection 319. Because of this, even though the connector cover 310 turns relative to the trunk wires 382 in directions indicated by arrows in FIG. 22B, the turn restricting projection 319 is brought into abutment with the trunk wires 382 to restrict the turn of the connector cover 310, thereby making it possible to restrict the turn of the connector cover 310 relative to the trunk wires 382. In this way, with the connector unit 330 according to this embodiment, the whole of the connector unit 330 is restricted from turning relative to the trunk wires 382, improving the working properties in attaching the connector unit 330 to the mating connector 340.

To describe further by reference to FIGS. 23A and 23B, when connector units 330B of the earlier invention that each have no turn restricting projection 319 are used, as shown in FIG. 23A, the connector units 330B turn relative to electric wires 380, resulting in a case where a plurality of connectors 320 are not aligned in the same orientation. In this way, in the event that there is difficulty in aligning the connectors 320 in the same orientation, the working properties in attaching the connectors 320 to mating connectors 340 are deteriorated. In contrast with this, when the connector units 330 according to this embodiment are used, as has been described above, the whole of the connector unit 330 is restricted from turning relative to the trunk wires 382. Thus, as shown in FIG. 23B, the connectors 320 can easily be aligned in the same orientation, this improving the working properties in attaching the connectors 320 to the mating connector units 340.

The connector unit 330 according to this embodiment will be summarized as below.

The connector unit 330 includes the connector 320 and the connector cover 310. The connector 320 accommodates the terminals that are electrically connected to the distal ends of the branch wires 381 that branch off the trunk wires 382. The connector cover 310 is formed into the shape of the bottomed tube that has the bottom wall 313 and the side walls and is assembled to the end of the connector 320 where the pull-out plane 325 where the branch wires 381 are pulled out is present. In the connector unit 330, the branch wires 381 and the trunk wires 382 are guided to the direction in which they are laid out by the connector cover 310. The connector cover 310 has the electric wire passage openings 317 that are formed in the side walls that face each other and the turn restricting projection 319 that is formed on the bottom wall 313, whereby the trunk wires 382 are passed through the electric wire passage openings 317 and the branch wires 381 are pulled out of the electric wire passage opening 317. In the event that the connector cover 310 turns relative to the trunk wires 382, the turn preventing projection 319 is brought into abutment with the trunk wires 382, and this restricts the turning of the connector cover 310.

It is noted that the technical scope of the invention is not limited by the embodiment. Various modifications, improvements or the like can be made to the embodiment without departing from the technical scope of the invention.

For example, in the embodiment, the connector units 330 are described as being used to restrict the layout path of the electric wires 380 that are laid out within the transmission case 370. However, needless to say, the connector unit 330 can be used for other applications than the layout of electric wires within the transmission case 370.

Fourth Embodiment

Hereinafter, a connector cover according to the fourth invention will be described in detail based on the drawings, the connector cover facilitating the identification of electric wires that exit from a connector to which the connector cover is fitted by orienting all connectors in the same direction and further being able to be restored to its original condition even though the connector cover turns relative to an axis that passes through a ceiling portion and a bottom portion of the connector cover.

<The Connector Cover 410 According to the Embodiment>

Figure 24A:
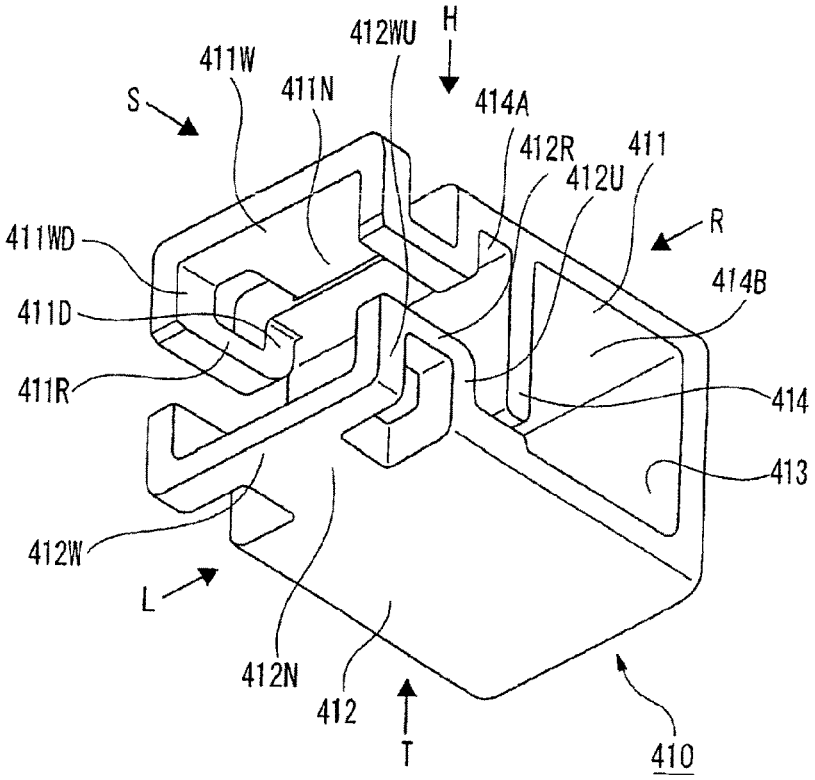
FIG. 24A is a perspective view of a connector cover according to a fourth embodiment of the invention as seen upwardly from therebelow.
Figure 24B:
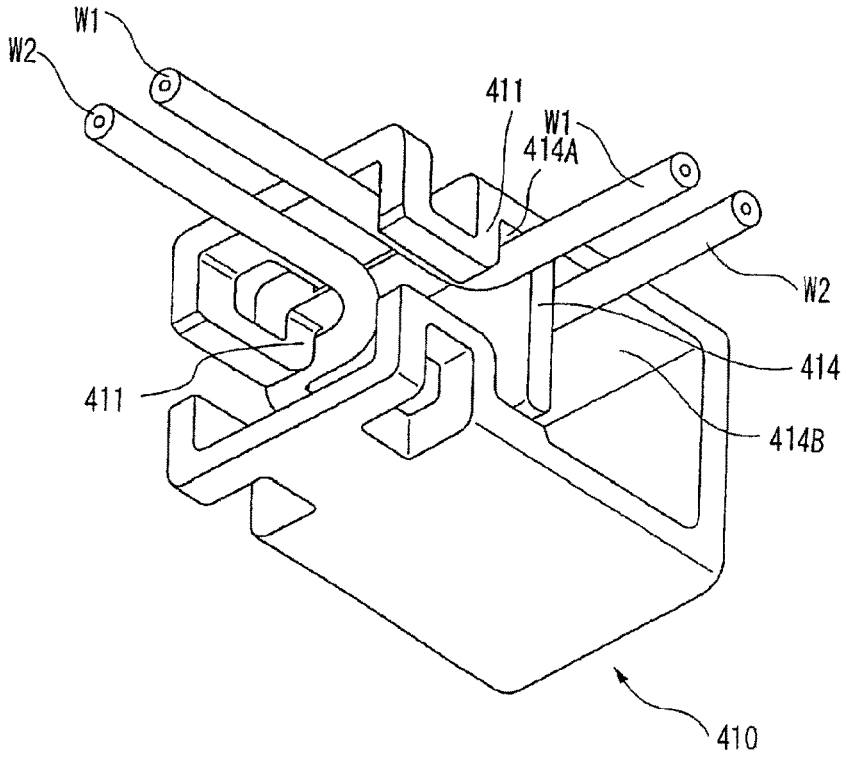
FIG. 24B is a perspective view of the connector cover shown in FIG. 24A as seen upwardly from therebelow, showing a state in which two electric wires that are pulled out of a connector are passed through an interior of the connector cover.

FIG. 24A is a perspective view of a connector cover according to the invention as seen upwardly from therebelow, and FIG. 24B is a perspective view of the connector cover shown in FIG. 24A as seen upwardly from therebelow, showing a state in which two electric wires that are pulled out of a connector are passed through an interior of the connector cover. The connector cover 410 according to the invention is basically the same as the connector cover 410 according to the earlier invention that is illustrated in FIG. 30A.

Figure 30A:
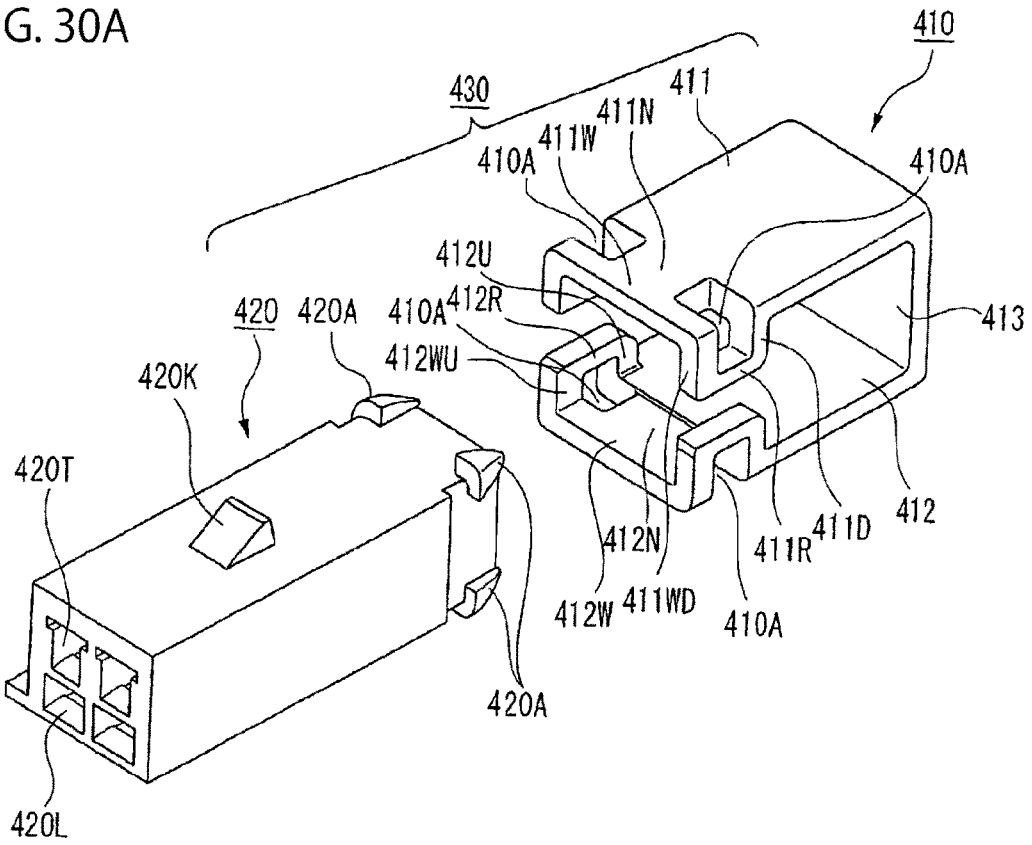
FIG. 30A is a perspective view of a connector and an connector cover according to the invention made earlier than the present invention, showing a state in which they are ready to be fitted together.
Figure 30B:
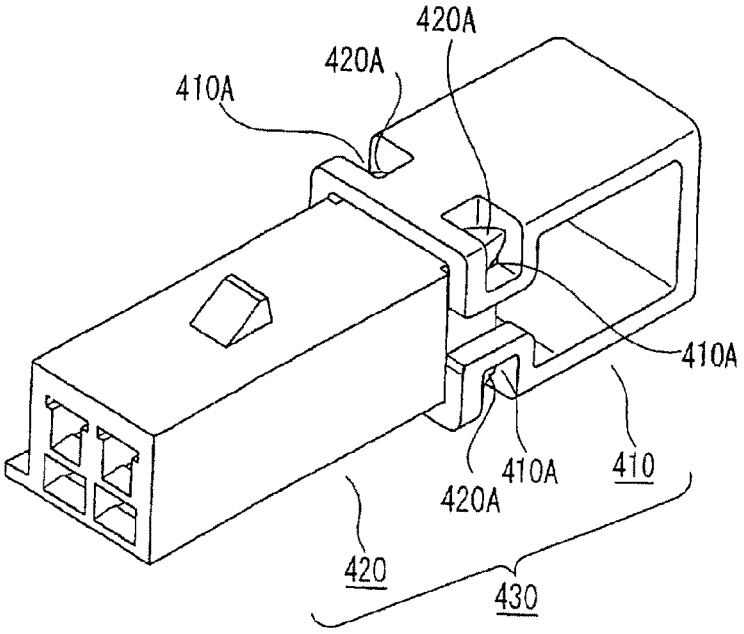
FIG. 30B is a perspective view of the connector and the connector cover, showing a state in which they are fitted together.

The connector cover 410 according to the invention differs from the connector cover 410 according to the earlier invention in that in the connector cover 410 of the invention, an electric wire distributing separator rib 414 having a predetermined width is formed integrally with the connector cover 410 from the same resin material as that of the connector cover 410 in such a way as to extend downwards from an inside of the ceiling portion 411 to reach near the bottom portion 412 of the connector cover 410 shown in FIG. 30A.

<The Electric Wire Distributing Separator Rib 414 According to the Embodiment>

FIGS. 25A-25E illustrate five plane views of the connector cover 410 according to the invention shown in FIG. 24A.

Figures 25A, 25B, 25C, 25D, 25E:
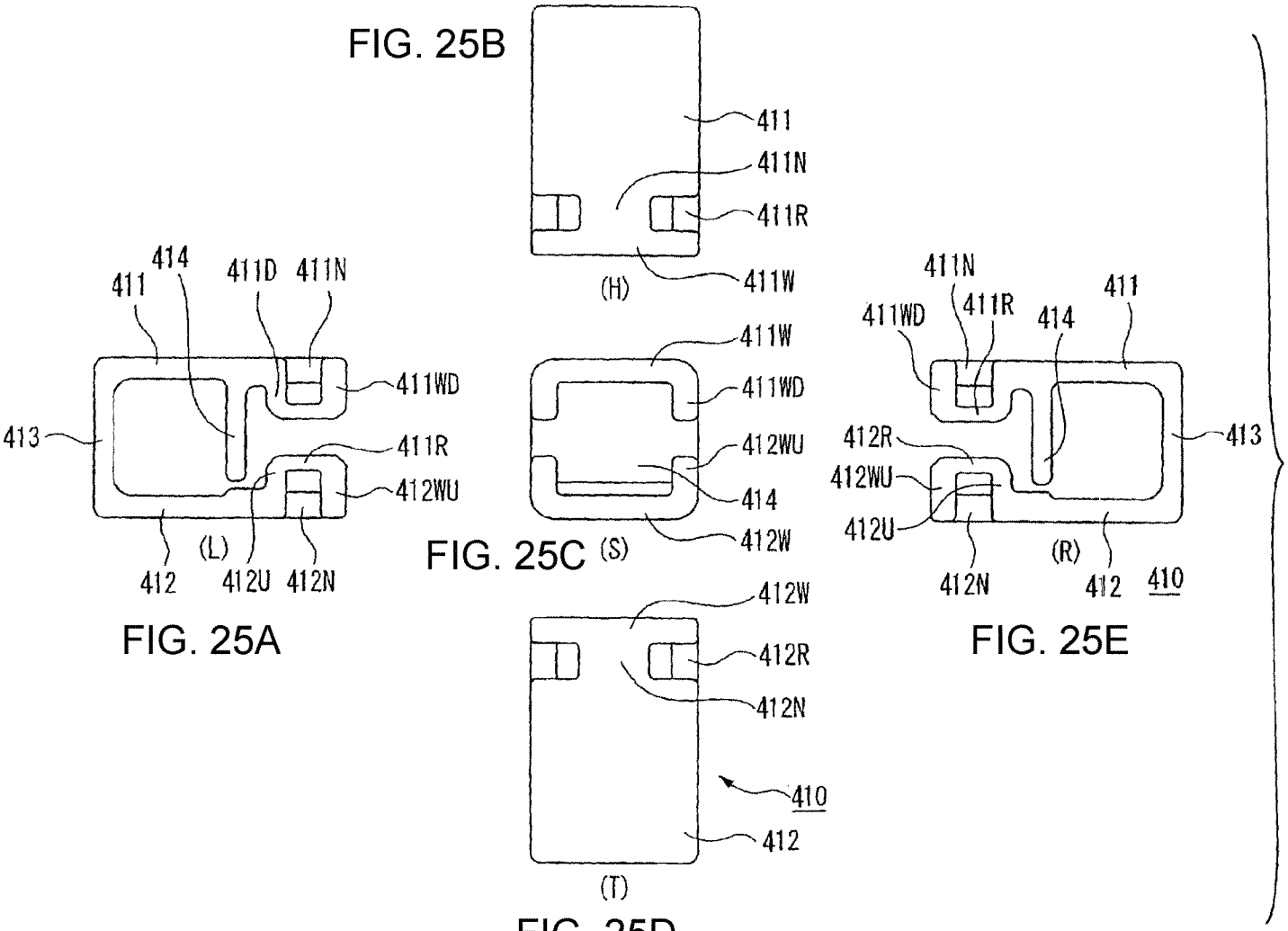
FIGS. 25A-25E illustrate five plane views of the connector cover shown in FIG. 24A, in which a view S in FIG. 25C is a front view, a view H in FIG. 25B is a plan view, a view T in FIG. 25D is a bottom view, a view R in FIG. 25E is a side view as seen from the right, and a view L in FIG. 25A is a side view as seen from the left.

In FIG. 25C, a view S in the center of five plane views is a front view. In FIG. 25B, a view H, above the view S of FIG. 25C, is a plan view, while in FIG. 25D, a view T, below the view S, is a bottom view. Additionally, in FIGS. 25E and 25A, a view R to the right of the view S is a side view as seen from the right, and a view L to the left of the view S is a side view as seen from the left, respectively.

It is seen from the five views that in the connector cover 410 according to the embodiment, an electric wire distributing separator rib 414 is formed so as to extend from an inside of a ceiling portion 411 to reach near a bottom portion 412 of the connector cover 410 while extending in a width direction of the connector cover to its full extent. Then, two electric wires from a connector to which the connector cover 410 is fitted are passed through the connector cover 410 (refer to FIG. 24B), which results in a state shown in FIGS. 26A-G.

Figures 26A, 26B, 26C, 26D, 26E, 26F, 26G:
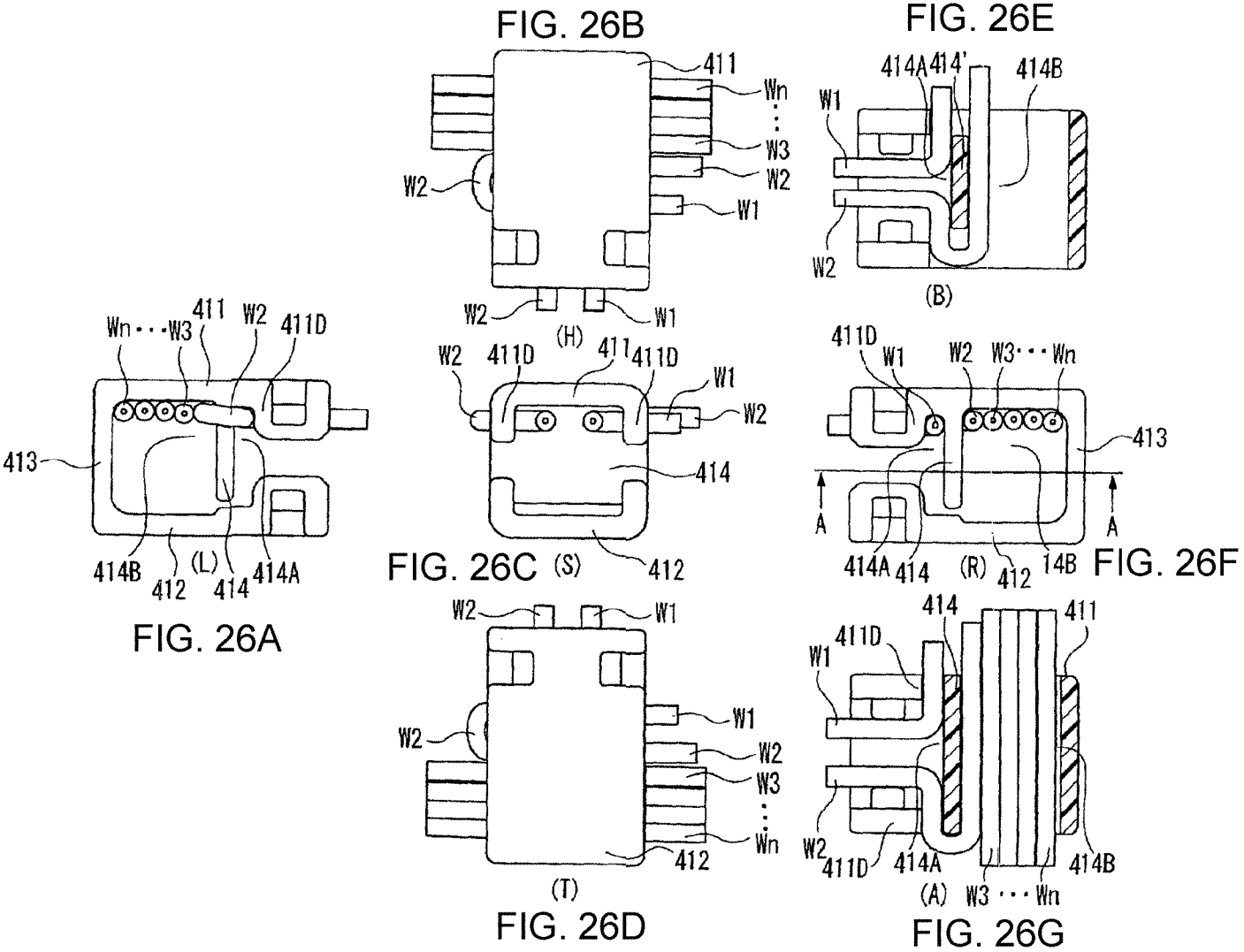
FIGS. 26A-G illustrate six plane views of the connector cover shown in FIG. 24B, in which a view S in FIG. 26C is a front view, a view H in FIG. 26B is a plan view, a view T in FIG. 26D is a bottom view, a view R in FIG. 26F is a side view as seen from the right, a view L in FIG. 26A is a side view as seen from the left, a view A in FIG. 26G is a sectional view of the view R in FIG. 26F as seen from a direction indicated by arrows A, and a view B in FIG. 26E shows a modified example of an electric wire distributing separator rib shown in the view A of FIG. 26G.

FIGS. 26A-26G illustrate six plane views of the connector cover shown in FIGS. 25A-25E resulting when the electric wires from the connector to which the connector cover is fitted are laid out in the connector cover. In the six-plane view, FIG. 26C illustrates a front view S, FIG. 26B illustrates a plan view H, FIG. 26D illustrates a bottom view T, FIG. 26F illustrates a right-side view R (e.g., as seen from the right), FIG. 26A illustrates a left-side view L (e.g., as seen from the left), and FIG. 26G illustrates a sectional view A taken along a line A-A in the view R of FIG. 26F as seen from a direction indicated by arrows A, A.

<Positional Relationship Between Two Electric Wires W1, W2 and the Electric Wire Distributing Separator Rib 414>

In FIGS. 26A-26G, of two electric wires W1, W2 from the connector to which the connector cover 410 is fitted, an electric wire W1 passes through an electric wire direction restricting portion 414A that is created between the electric wire distributing separator rib 414 and a downwardly extending portion 411D of the ceiling portion 411 in such a way as to clear it (refer to FIG. 26G).

In addition, of the electric wires W1, W2, the other electric wire W2 passes through the electric wire direction restricting portion 414A towards an opposite side to the side to which the electric wire W1 is directed in such a way as to clear it and moves around the electric wire distributing separator rib 414, whereafter the electric wire W2 passes through an electric wire collecting portion 414B defined between the electric wire distributing separator rib 414 and a wall portion 413 to be oriented in the same direction as the direction in which the electric wire W1 is oriented (refer to FIG. 26G).

Additionally, a large number of electric wires W3 to Wn that come from other connectors pass through the electric wire collecting portion 414B (refer to FIG. 26G).

<Maintaining of a Horizontal State by the Electric Wire Distributing Separator Rib 414: Advantage 1>

In this way, one (W1) of the two electric wires W1, W2 passes a front side (a side facing the connector) of the electric wire distributing separator rib 414 of the connector cover, and the other electric wire (W2) passes a rear side (a side facing the wall portion 413) of the electric wire distributing separator rib 414. Therefore, the two electric wires W1 and W2 are aligned parallel at the same height with the electric wire distributing separator rib 414 held therebetween, this enabling the connector cover to maintain its horizontal state (refer to FIG. 27).

This will be true with all connector covers adopting the configuration described above, and hence, connector units having the connector covers are allowed to maintain their horizontal state.

A group of electric wires that arrive at a connector unit 430 from other connector units 430 should be passed through the electric wire collecting portion 414B horizontally.

Figure 27:
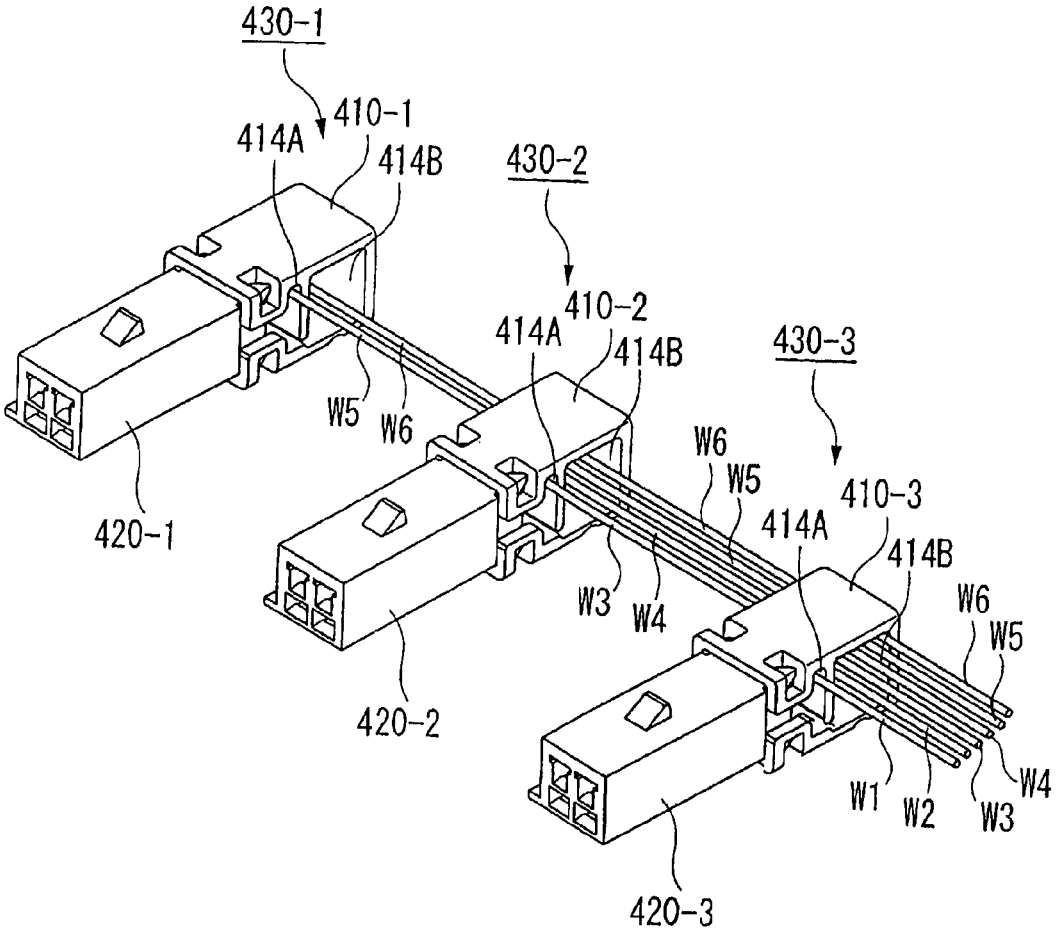
FIG. 27 is a perspective view showing a positional relationship between the connector units according to the fourth embodiment of the invention and a large number of electric wires.

As a result of this, all the connector units 430 are allowed to maintain their horizontal state as shown in FIG. 27.

<All Connector Units Maintain their Horizontal State Similarly>

FIG. 27 is a perspective view showing a positional relationship between connector units according to the invention and a large number of electric wires. As has been described above, all connector units 430-1 to 430-3 have connector covers 410-1 to 410-3 according to the invention, and therefore, all the connector units 430-1 to 430-3 maintain their horizontal state.

Consequently, when the connector units 430-1 to 430-3 are fitted to their mating connectors, the connector units 430-1 to 430-3 are aligned to be directed in the same orientation, and therefore, the fitting work can be performed efficiently.

In addition, one of electric wires of the connector unit 430 to which the connector cover 410 is fitted is passed horizontally into the electric wire direction restricting portion 414A of the connector cover 410, and the remaining electric wire of the electric wires of the connector unit 430 and a group of electric wires that comes from the other connector units 430 to arrive thereat are passed horizontally through the electric wire collecting portion 414B, whereby all the electric wires are arranged side by side into a flat state. From this point of view, the connector is prevented from being turned further. Then, when the connector units are fitted to their mating connectors, the connector units are aligned to be directed in the same orientation, and therefore, the fitting work can be performed efficiently.

<Easy Identification of Electric Wires from the Connector to which the Connector Cover is Fitted by the Electric Wire Distributing Separator Rib 414: Advantage 2>

One of electric wires that exit from a connector to which the connector cover is fitted never fails to be distributed by passing the side of the electric wire distributing separator rib 414 of the connector cover that faces the electric wire direction restricting portion 414A, and therefore, by looking at the electric wire passing through the electric wire direction restricting portion 414A, it is easy to identify the electric wire as the electric wire coming from the connector to which the connector cover is fitted.

<Even Though the Connector Cover Turns, the Connector Cover is Restored to its Original Condition: Advantage 3>

The electric wire W2 of the two electric wires W1, W2 is distributed from the front side (the side facing the connector) to the rear side (the side facing the wall portion 413) of the electric wire distributing separator rib 414 in such a way that the electric wire W2 is distributed around the electric wire distributing separator rib 414 (refer to FIG. 26G). Therefore, even though the connector cover attempts to turn about the axis that passes through the ceiling portion and the bottom portion thereof, it is difficult for the connector cover to turn so. Should the connector cover be allowed to turn, a force attempting to restore the electric wire that is distributed around the electric wire distributing separator rib 414 while in contact therewith to its original condition is generated in the electric wire so distributed, and this force acts to restore the connector cover to its original condition easily. Consequently, even in case the connector cover turns, the orientation of the connector cover is restored to its original position, and therefore, the fitting work can be performed efficiently.

<Other Variations>

In the description made heretofore, the connector cover is described as having the rectangular parallelepiped shape. However, the shape is not limited to the rectangular parallelepiped, and hence, needless to say, the connector cover may have a cubical shape.

In addition, the electric wire distributing separator rib 414 is described as being formed so as to extend downwards from the ceiling portion 411. However, the electric wire distributing separator rib 414 may be formed so as to extend upwards from the bottom portion 412, provided that the electric wires can be passed therealong or therearound.

Further, as is seen from FIG. 26G, the turn preventing function is given to the electric wire distributing separator rib 414 by forming the rib so as to have the width that equals the width (in the direction that is at right angles to the fitting direction) of the connector cover 410. However, in this configuration, the electric wire protrudes sideways from the connector cover 410. When the protrusion of the electric wire is wanted to be avoided, as shown in FIG. 26E, an electric wire distributing separator rib 414' should be provided instead which is formed slightly shorter than the electric wire distributing separator rib 414 while being given the turn preventing function, so that the electric wire can be prevented from protruding sideways from the connector cover 410.

<Further Improvement of the Connector 410 According to the Embodiment>

Figure 28A:
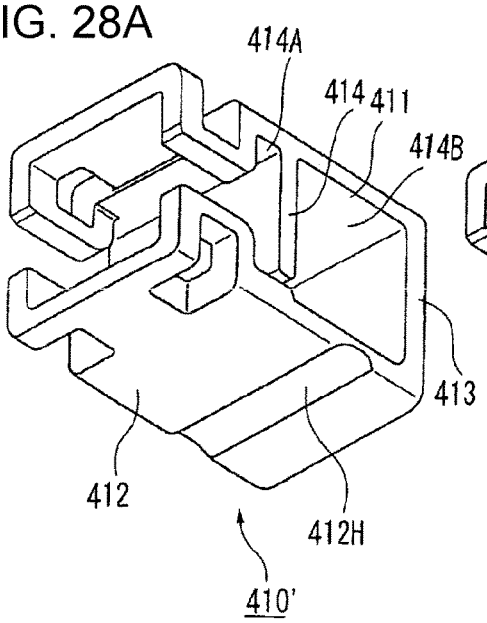
Figure 28B:
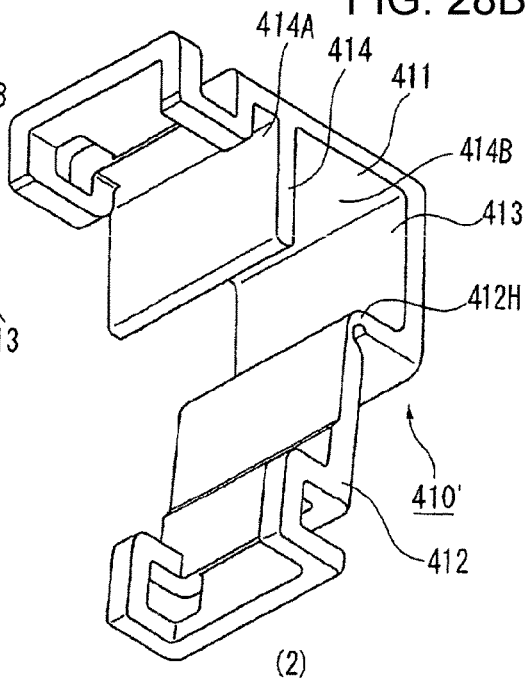
Figure 28C:
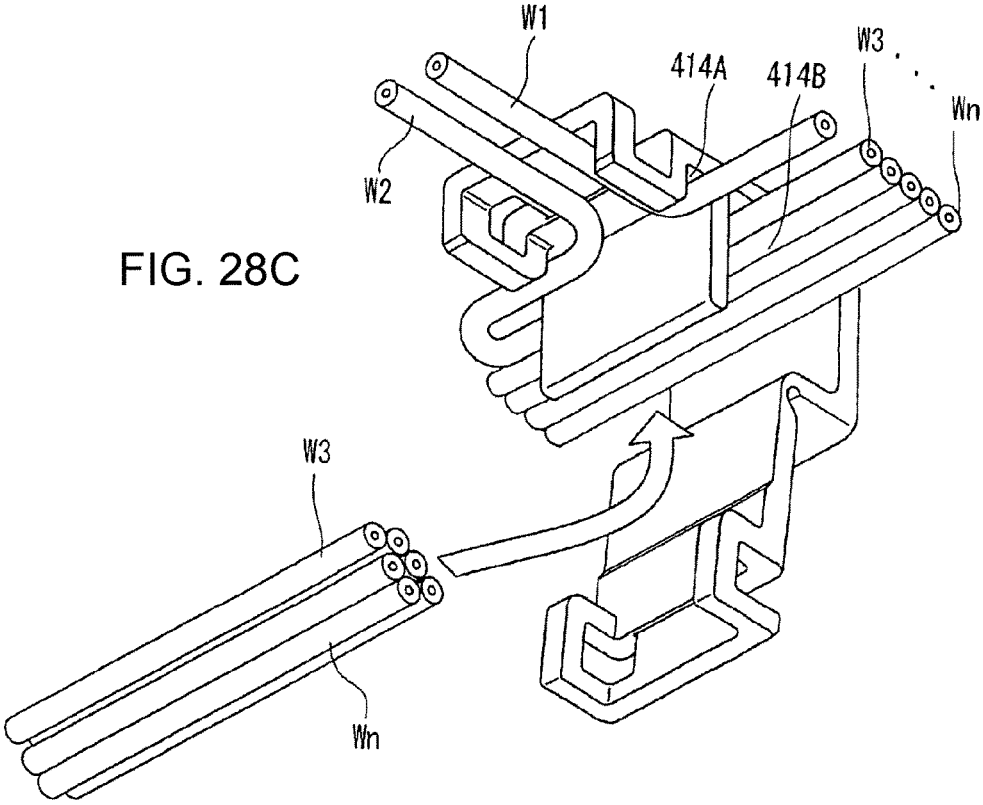

FIGS. 28A-C illustrate views showing a further improvement of the connector cover shown in FIG. 24 or a perspective view of a connector cover as seen upwards from therebelow in which a hinge is formed on a bottom portion 412. FIG. 28A shows a state in which the hinge is closed, FIG. 28B shows a state in which the hinge is opened, and FIG. 28C is a view showing a state in which electric wires are passed through the connector cover with the hinge opened.

Figures 29A, 29B, 29C, 29D, 29E:
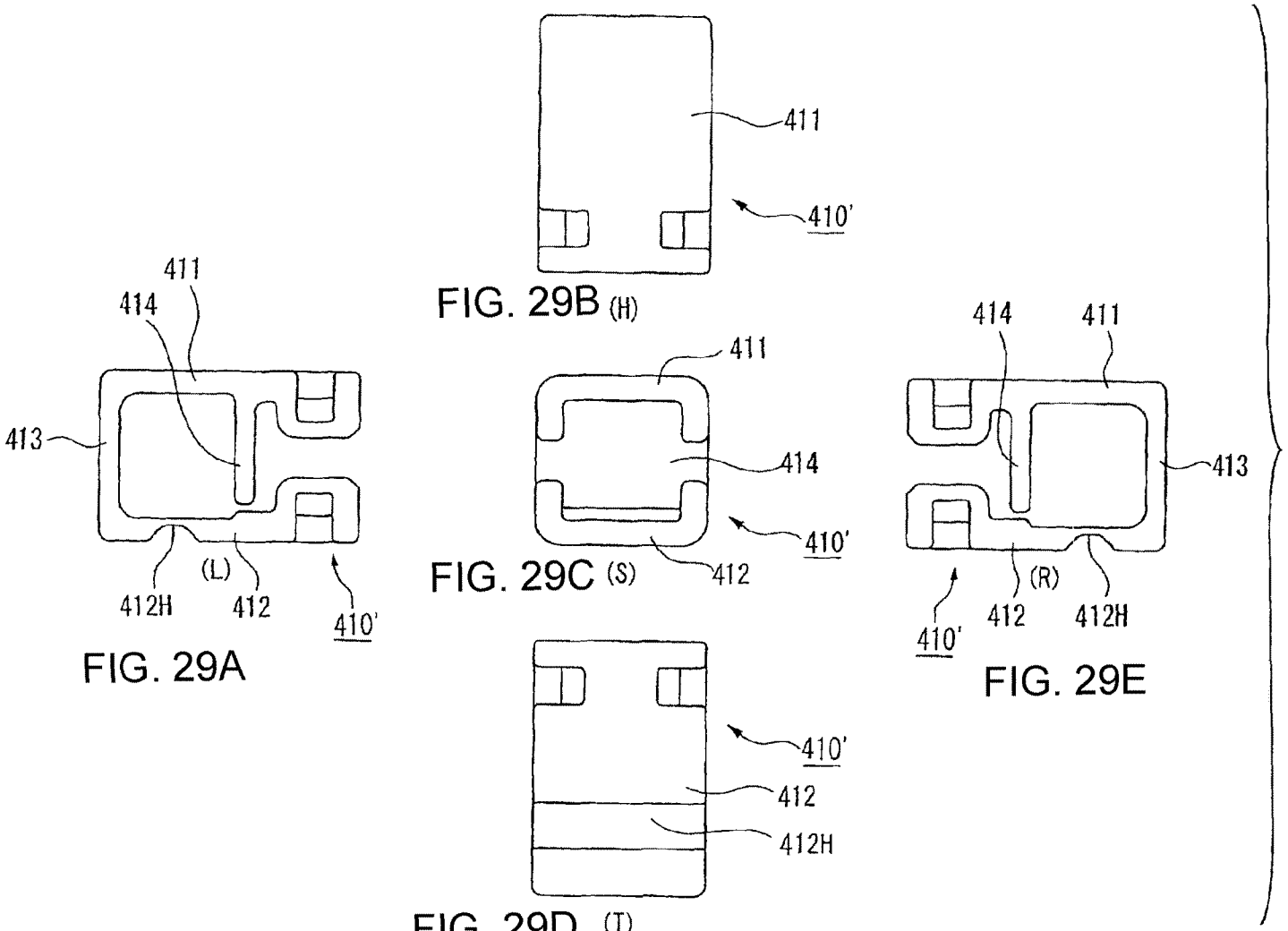
FIGS. 29A-29E illustrate five plane views of the connector cover with the hinge opened in FIG. 28A, in which a view S of FIG. 29C is a front view, a view H of FIG. 29B is a plan view, a view T of FIG. 29D is a bottom view, a view R of FIG. 29E is a side view as seen from the right, and a view L of FIG. 29A is a side view as seen from the left.

In addition, FIGS. 29A-E illustrate five plane views of the connector cover shown in FIG. 28A with the hinge closed, in which a view S of FIG. 29C is a front view, a view H of FIG. 29B is a plan view, a view T of FIG. 29D is a bottom view, a view R of FIG. 29E is a side view as seen from the right, and a view L of FIG. 29A is a side view as seen from the left.

As shown in FIG. 28A, a hinge 412H is formed on the bottom portion 412 in a position lying near a wall portion 413 so as to extend fully along a direction that is at right angles to the fitting direction (sideways). On the other hand, an electric wire distributing separator rib 414 is formed so as to extend downwards from an inside of a ceiling portion 411 as described above. Thus, when a fitting end of the bottom portion 12 is turned about the hinge 412H, as shown in FIG. 28B, a large space is opened between a distal end of the electric wire distributing separator rib 414 and the hinge 412H.

Consequently, when a large number of electric wires W3 to Wn from other connector units than a connector unit to which the connector cover is fitted are passed through an electric wire collecting portion 414B of the connector unit that is defined between the electric wire distributing separator rib 414 of the connector unit and the wall portion 413 of the connector cover 410, the fitting engagement at the fitting end of the bottom portion 412 that is closed (refer to FIG. 28A) is released, and the connector fitting end of the bottom portion 412 is rotated downwards about the hinge 412H as shown in FIG. 28B, whereby the large space is opened between the electric wire distributing separator rib 414 and the hinge 412H. Then, the electric wires W3 to Wn should be pushed into the space at their halfway portions and are then aligned horizontally as shown in FIG. 28C.

Thereafter, the fitting end of the bottom portion 412 is closed. Then, left and right fitting projections 420A that are formed at corresponding locations of a connector 420 are locked individually in fitting spaces 410A that are present in left and right portions of the bottom portion 412 of the connector cover 410, whereby the large number of electric wires W3 to Wn from the other connector units 430 can be passed through the electric wire collecting portion 414B of the connector cover 410 of the connector unit 430 while being aligned horizontally.

SUMMARY

By forming the hinge in the bottom portion, when the fitting end of the bottom portion is rotated about the hinge, the large space is opened between the electric wire distributing separator rib and the hinge, and therefore, the large number of electric wires from the other connector units can easily be collected into the electric wire collecting portion of the connector cover.

On the other hand, in the case of the connector cover as shown in FIG. 24 which is free from the hinge 412H described above, the respective distal ends of the large number of electric wires W3 to Wn from the other connector units are necessary to be passed through the electric wire collecting portion 414B of the connector cover 410 of the connector unit 430. This work needs to involve some labor hours and is hence troublesome. In addition, the connector unit according to this embodiment is improved compared to the relevant connector unit shown in FIGS. 31A-31E.

According to the invention, there is provided an advantage that electric wires pulled out of a connector can easily be oriented in one direction. The invention providing the advantage is useful for use with a connector unit including a connector and a connector cover that fits on the connector and protects electric wires pulled out of the connector.

What is claimed is:

1. An electrical connector unit comprising:

a connector including a connector housing that accommodates a terminal that is attached to an electric wire; and a connector cover that is assembled to an electric wire pull-out opening in the connector housing, the connector cover configured to receive the electric wire that is pulled out of the connector housing in a pull-out direction;

another connector including a connector housing that accommodates a terminal that is attached to another electric wire;

another connector cover configured to receive the another electric wire, wherein:

the connector cover has a bottomed tubular shape, and includes two electric wire passage openings formed in side walls of the connector cover, the two electric wire passage openings constituting an entrance or an exit for the another electric wire that is laid out from the another connector cover, the two electric wire passage openings allowing the another electric wire to extend through an entirety of the connector cover in a lay-out direction perpendicular to the pull-out direction, the two electric wire passage openings further configured to guide the electric wire that is pulled out of the connector housing in the lay-out direction, each of the two electric wire passage openings having a first opening end and a second opening end in the pull-out direction, wherein the first opening end is larger in a width direction perpendicular to the lay-out direction and the pull-out direction than the second opening end, and the another connector cover adjacent and parallel to the connector cover, configured to guide the another electric wire in the lay-out direction to the connector cover.

2. The electrical connector unit according to claim 1, wherein:

the connector cover is axially symmetrical, and the connector housing has an axially symmetrical shape in which an axis of an electric wire pull-out-side end portion of the connector housing coincides with an axis of an opening-side end portion of the connector cover, enabling the electric wire pull-out-side end portion to fit into the opening-side end portion.

3. The electrical connector unit according to claim 2, wherein:

the electrical connector unit further has an axial rotation locking portion that locks the connector cover and the connector housing at a plurality of locations, and when the connector cover is engaged with the connector unit, the connector cover is rotatable about the axis of the axial rotation locking portion relative to the connector housing.

4. The electrical connector unit according to claim 2, wherein:

in the connector cover, an external shape of a section orthogonal to the axis of the opening-side end portion is square, and in the connector housing, an external shape of a section orthogonal to the axis of the electric wire pull-out-side end portion is square so that the electric wire pull-out-side end portion of the connector housing can fit in the opening-side end portion of the connector cover.

5. The electrical connector unit according to claim 1, wherein the connector is configured to be insertable into the connector cover such that the connector cover overlaps at least a portion of the connector in each of the pull-out direction and the width direction, wherein the first opening end of each of the two electric wire passage openings is closer to a closed end of the connector cover and the second opening end of each of the two electric wire passage openings is closer to an open end of the connector cover.

6. The electrical connector unit according to claim 1, wherein an insertion end of the connector includes at least one engaged member configured to engage with engageable openings of the connector cover, the engageable openings disposed closer to the second opening end of the two electric wire passage openings than to the first opening end of the two electric wire passage openings.

7. The electrical connector unit according to claim 6, wherein the engageable openings are disposed at a same position, in the pull-out direction, as the second opening end of the two electric wire passage openings.

* * * * *